US011101601B2

(12) United States Patent
Itou

(10) Patent No.: US 11,101,601 B2
(45) Date of Patent: Aug. 24, 2021

(54) CONNECTOR

(71) Applicant: Japan Aviation Electronics Industry, Limited, Tokyo (JP)

(72) Inventor: Yasukazu Itou, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 159 days.

(21) Appl. No.: 16/495,222

(22) PCT Filed: Mar. 9, 2018

(86) PCT No.: PCT/JP2018/009289
§ 371 (c)(1),
(2) Date: Sep. 18, 2019

(87) PCT Pub. No.: WO2018/198550
PCT Pub. Date: Nov. 1, 2018

(65) Prior Publication Data

US 2020/0028303 A1 Jan. 23, 2020

(30) Foreign Application Priority Data

Apr. 28, 2017 (JP) ..... JP2017-089941

(51) Int. Cl.
*H01R 13/11* (2006.01)
*H01R 13/436* (2006.01)
(Continued)

(52) U.S. Cl.
CPC ..... *H01R 13/6315* (2013.01); *H01R 13/112* (2013.01); *H01R 13/502* (2013.01)

(58) Field of Classification Search
CPC ..... H01R 13/506; H01R 13/6315; H01R 13/112; H01R 13/113; H01R 13/502; H01R 13/4364
See application file for complete search history.

(56) References Cited

U.S. PATENT DOCUMENTS 8,177,587 B2 * 5/2012 Takagi ..... H01R 13/6315 439/733.1
9,172,168 B2 * 10/2015 Ebisawa ..... H01R 13/04
(Continued)

FOREIGN PATENT DOCUMENTS

CN 203660125 A 6/2014
CN 105191004 A 12/2015
(Continued)

OTHER PUBLICATIONS

International Search Report of PCT/JP2018/009289, dated May 15, 2018.
(Continued)

*Primary Examiner* — Abdullah A Riyami
*Assistant Examiner* — Thang H Nguyen
(74) *Attorney, Agent, or Firm* — Collard & Roe, P.C.

(57) ABSTRACT

A connector that can accommodate displacement and tilting at the time of fitting into a counterpart connector and that can avoid an increase in the size of the connector is provided. A movable contact of a connector has: upper-side contact points; lower-side contact points; upper-side gripping sections; lower-side gripping sections; an upper-side spring part; a lower-side spring part; and two joining sections. The upper-side contact points and the lower-side contact points can move independently of each other due to elastic deformation of the upper-side spring part and the lower-side spring part. An upper-side second width of the upper-side spring part at a second position is smaller than an upper-side first width of the upper-side spring part at a first position. A lower-side second width of the lower-side spring part at the second position is smaller than a first lower-side width of the lower-side spring part at the first position.

9 Claims, 16 Drawing Sheets

(51) Int. Cl.

| | |
|---|---|
| ***H01R 13/502*** | (2006.01) |
| ***H01R 13/506*** | (2006.01) |
| ***H01R 13/631*** | (2006.01) |

(56) References Cited

U.S. PATENT DOCUMENTS

| | | | | |
|---|---|---|---|---|
| 9,570,722 | B2 * | 2/2017 | Ebisawa | H01M 50/20 |
| 9,698,508 | B2 | 7/2017 | Kobayashi et al. | |
| 2011/0065331 | A1 * | 3/2011 | Takagi | H01R 13/113 439/733.1 |
| 2015/0357734 | A1 * | 12/2015 | Copper | H01R 13/08 439/660 |
| 2016/0294089 | A1 | 10/2016 | Kobayashi et al. | |
| 2017/0033480 | A1 * | 2/2017 | Sato | H01R 13/04 |
| 2017/0170588 | A1 * | 6/2017 | Doi | H01R 13/502 |
| 2017/0338592 | A1 * | 11/2017 | Doi | H01R 12/7035 |

FOREIGN PATENT DOCUMENTS

| | | | |
|---|---|---|---|
| CN | 106058569 | A | 10/2016 |
| DE | 11 2015 001 539 | T5 | 12/2016 |
| EP | 2 775 548 | A1 | 9/2014 |
| EP | 2790276 | A1 | 10/2014 |
| JP | 2008-078093 | A | 4/2008 |
| JP | 2011-060732 | A | 3/2011 |
| JP | 2012-195299 | A | 10/2012 |
| JP | 2013-008612 | A | 1/2013 |
| JP | 2014-107016 | A | 6/2014 |
| JP | 2015-133204 | A | 7/2015 |
| JP | 2016-134284 | A | 7/2016 |
| WO | 2008/039464 | A1 | 4/2008 |
| WO | 2014/159908 | A1 | 10/2014 |
| WO | 2015/199071 | A1 | 12/2015 |
| WO | 2016/117276 | A1 | 7/2016 |

OTHER PUBLICATIONS

Extended European Search Report in 18790735.7-1201, dated Feb. 12, 2020.

Chinese Office Action dated Jun. 3, 2020 in Chinese Application No. 201880021440.1 with English translation.

Japanese Office Action dated May 9, 2018 in Japanese Application No. 2017-089941 with English translation.

* cited by examiner

CONNECTOR

CROSS REFERENCE TO RELATED APPLICATIONS

This application is the National Stage of PCT/JP2018/009289 filed on Mar. 9, 2018, which claims priority under 35 U.S.C, § 119 of Japanese Application No. 2017-089941 filed on Apr. 28, 2017, the disclosures of which are incorporated by reference. The international application under POT article 21 (2) was not published in English.

TECHNICAL FIELD

This invention relates to a connector, particularly to a connector to be connected to a busbar.

BACKGROUND ART

As a connector of this type, there is a connector disclosed in Patent Document 1. As shown in FIG. 30, a connector 80 disclosed in Patent Document 1 is provided with a fixed-side housing 82, a fixed-side contact 84, a movable-side housing 86 and a movable-side contact 88. The fixed-side contact 84 is fixed to the fixed-side housing 82. The movable-side housing 86 is attached to the fixed-side housing 82 so as to be slidable in a direction perpendicular to a mating and removing direction F and a lateral direction Y. Referring to FIG. 31 in addition to FIG. 30, the movable contact 88 has first contact portions 882 which are in contact with the fixed-side contact 84 and second contact portions 884 to be brought into contact with a mating contact 92. The first contact portions 882 are always in contact with the fixed-side contact 84. The second contact portions 884 are brought into contact with the mating contact 92 when the connector 80 is mated with a mating connector 90. According to this structure, even when there is misalignment between both of the connectors 80 and 90 upon mating the connector 80 with the mating connector 90, the misalignment can be absorbed by tilting the movable-side contact 88.

PRIOR ART DOCUMENTS

Patent Document(s)

Patent Document 1: JPA 2011-60732

SUMMARY OF INVENTION

Technical Problem

The connector of Patent Document 1 can absorb inclination such as a state that the mating connector is slightly turned around a turning axis extending along the mating and removing direction F. However, there is a problem that a size of the connector must become larger in order to allow this inclination of the mating connector by deformation of the movable-side contact.

It is therefore an object of the present invention to provide a connector which can absorb misalignment and inclination of a mating connector upon mating it with the mating connector and which can avoid increasing a size of the connector.

Solution to Problem

An aspect of the present invention provides a connector which is provided with a fixed contact, a fixed housing, a movable contact and a movable housing. The movable housing has an opening portion. The movable housing is attached to the fixed housing so as to be movable in an up-down direction. The fixed housing and the movable housing define an accommodation portion. The opening portion communicates with the accommodation portion and opens forward in a front-rear direction perpendicular to the up-down direction. The fixed contact has a gripped portion. The fixed contact is fixed to and held by the fixed housing. The gripped portion is positioned in the accommodation portion. The gripped portion extends forward in the front-rear direction. The movable contact has two upper-side contact points, two lower-side contact points, an upper-side gripping section, a lower-side gripping section, an upper-side spring part, a lower-side spring part and two joining sections. The upper-side spring part is resiliently deformable. The upper-side spring part supports the upper-side contact points and the upper-side gripping section. The lower-side spring part is resiliently deformable. The lower-side spring part supports the lower-side contact points and the lower-side gripping section. The upper-side contact points and the lower-side contact points correspond respectively. One upper-side contact point and one lower-side contact point corresponding thereto face each other in the up-down direction. The upper-side contact points are movable independently of each other due to resilient deformation of the upper-side spring part. The lower-side contact points are movable independently of each other due to resilient deformation of the lower-side spring part. The upper-side gripping section and the lower-side gripping section grip the gripped portion of the fixed contact in the up-down direction. Each of the joining sections joins the upper-side spring part and the lower-side spring part to each other. A size of the joining sections in the front-rear direction is smaller than a size of each of the upper-side spring part and the lower-side spring part in the front-rear direction. In the front-rear direction, the joining sections are positioned at a first position. In the front-rear direction, the upper-side contact points and the lower-side contact points are positioned at a second position positioned frontward of the first position. In the front-rear direction, the upper-side gripping section and the lower-side gripping section are positioned at a third position positioned rearward of the first position. In a lateral direction perpendicular to both of the up-down direction and the front-rear direction, the upper-side spring part has an upper-side first width in the first position and an upper-side second width in the second position. A size of the upper-side second width is smaller than a size of the upper-side first width. In the lateral direction, the upper-side contact points are positioned between the joining sections. In the lateral direction, the lower-side spring part has a lower-side first width in the first position and a lower-side second width in the second position. A size of the lower-side second width is smaller than a size of the lower-side first width. In the lateral direction, the lower-side contact points are positioned between the joining sections.

Another aspect of the present invention provides a connector assembly which is provided with the aforementioned connector and a mating connector. The connector has two of the opening portions, two of the accommodation portions, two of the fixed contacts and two of the movable contacts. The opening portions are juxtaposed with each other in the up-down direction. The movable housing has a protruding portion which is positioned between the opening portions and which protrudes forward in the front-rear direction. The mating connector is provided with two busbars and a busbar holder. The busbars are integrally held by the busbar holder.

The busbar holder has a recess portion positioned between the busbars. When the mating connector is connected to the connector, the protruding portion is received by the recess portion at least in part.

Advantageous Effects of Invention

Since the connector according to the aspect of the present invention is provided with the movable contact and the movable housing, it can absorb misalignment of the busbars and achieve a good connection.

Moreover, in the connector according to the aspect of the present invention, the upper-side contact points and the lower-side contact points are positioned between the joining sections in the lateral direction. Accordingly, an inclination of the busbars can be absorbed by relatively little movement of the upper-side contact points and the lower-side contact points. Thus, it is possible to reduce space margins for moving of the upper-side contact points and the lower-side contact points and to downsize the connector.

DESCRIPTION OF EMBODIMENTS

Figure 1:
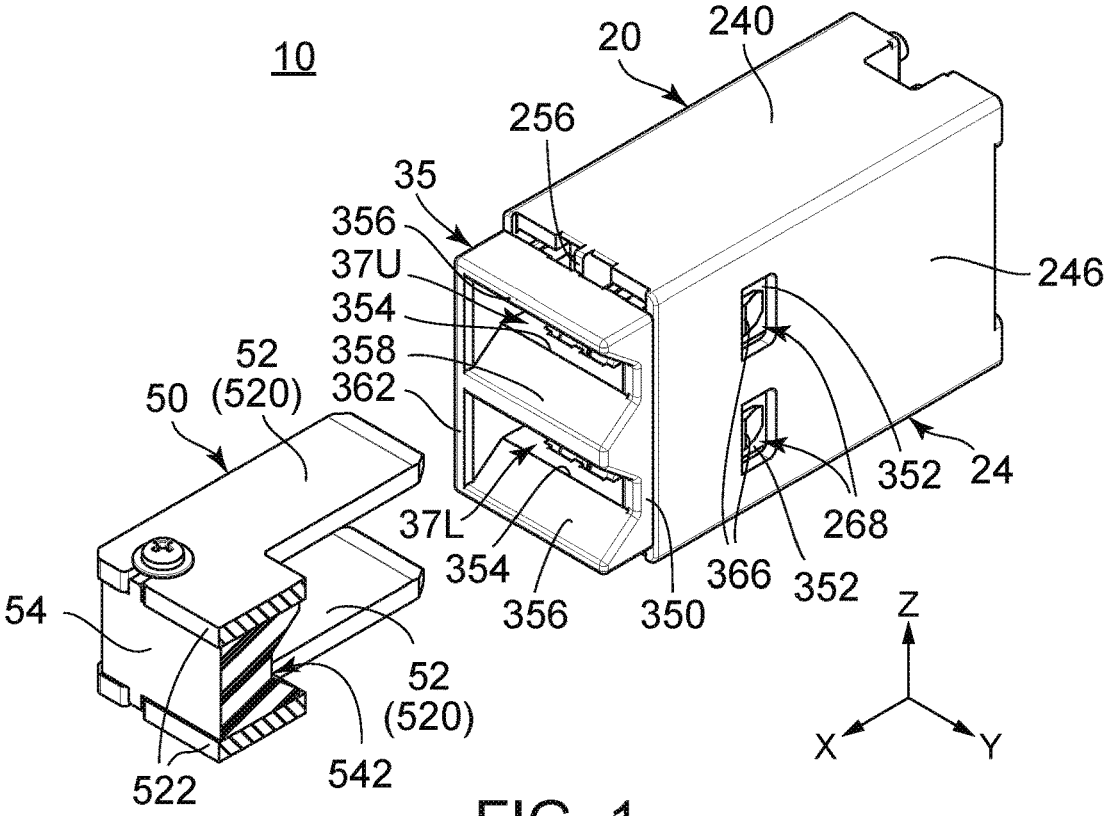
FIG. 1 is a front, perspective view showing a connector assembly according to an embodiment of the present invention. A connector and a mating connector are separated from each other. The mating connector is cut, and a part thereof is removed.
Figure 2:
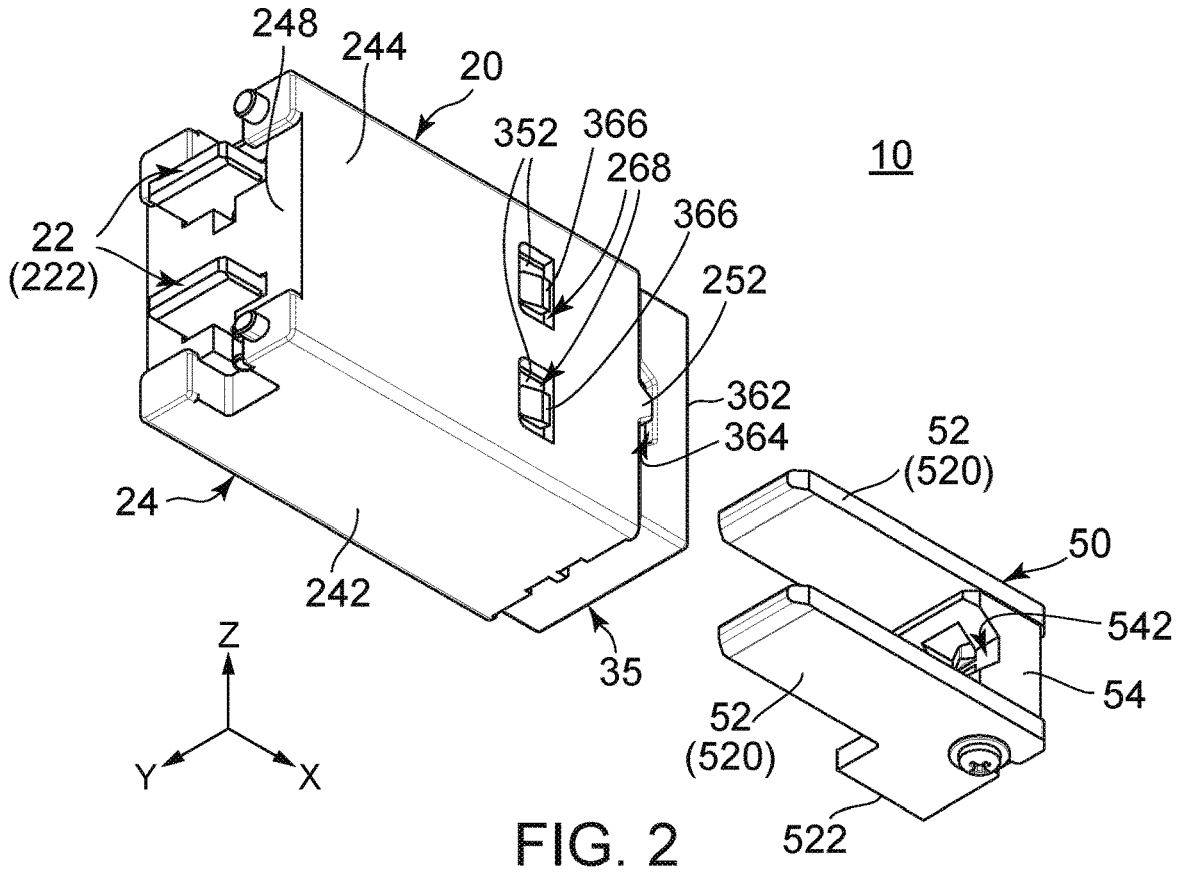
FIG. 2 is a rear, perspective view showing the connector assembly of FIG. 1.

Referring to FIGS. 1 to 4, a connector assembly 10 according to an embodiment of the present invention is provided with a connector 20 and a mating connector 50. The connector 20 is mateable with and removable from the mating connector 50 along a front-rear direction. In the present embodiment, the front-rear direction is an X-direction. Moreover, in the present embodiment, a positive X-direction is directed forward while a negative X-direction is directed rearward.

As shown in FIGS. 1 to 4, the mating connector 50 is provided with two busbars 52 and a busbar holder 54 integrally holding these busbars 52. The busbars 52 are made of metal plates, for example, copper plates. Surfaces of the busbars 52 may be subjected to plating. The busbar holder 54 is made of an insulating material. The two busbars 52 are arranged in parallel with and apart from each other in an up-down direction perpendicular to the front-rear direction. In the present embodiment, the busbars 52 are screwed to the busbar holder 54. The busbar holder 54 insulates electrically the two busbars 52 from each other. In the present embodiment, the up-down direction is a Z-direction. Moreover, in the present embodiment, a positive Z direction is directed upward while a negative Z-direction is directed downward. Additionally, although the busbars 52 are two in number in the present embodiment, the present invention is not limited thereto. The number of the busbar(s) may be one or three or more.

As shown in FIGS. 1 to 4, each of the busbars 52 has a connection portion 520 extending along the front-rear direction and an extension portion 522 extending from a front part of the connection portion 520 in a direction intersecting with the front-rear direction. In the present embodiment, the extension portions 522 of the two busbars 52 extend in the same direction along a lateral direction perpendicular to both of the front-rear direction and the up-down direction. In the present embodiment, the lateral direction is a Y-direction. Additionally, in the present embodiment, the two busbars 52 have the same shape and the same size. However, the present invention is not limited thereto. Provided that the busbars 52 have shapes similar to each other, they may have different sizes. For example, the connection portions 520 of the two busbars 52 may be different from each other in length.

As understood from FIGS. 1 to 4, the busbar holder 54 is provided along the extension portions 522 of the busbars 52. The busbar holder 54 has a recess portion 542 in a rear part thereof. The recess portion 542 is positioned between the two busbars 52 and recessed frontward.

As understood from FIGS. 5 to 8, the connector 20 is provided with two fixed contacts 22, a fixed housing 24, two sets of first and second contact members 30 and 32, a movable housing 35 and two spring pins 38. In the present embodiment, each set of the first and the second contact members 30 and 32 constitute a movable contact 28. In other words, the connector 20 is provided with two of the movable contacts 28. However, the present invention is not limited thereto. The number of the fixed contact(s) 22, the number of the movable contact(s) 28 and the number of the spring pin(s) 38 are decided according to the number of the busbar(s) 52 (see FIG. 1) of the mating connector 50. In the present embodiment, the two fixed contacts 22 are formed into the same shape by using the same material. Moreover, in the present embodiment, the two movable contacts 28 are formed into the same shape by using the same material. However, the present invention is not limited thereto. The two fixed contacts 22 may have different shapes different from each other. Also, the two movable contacts 28 may be formed to have different shapes different from each other.

Figure 9:
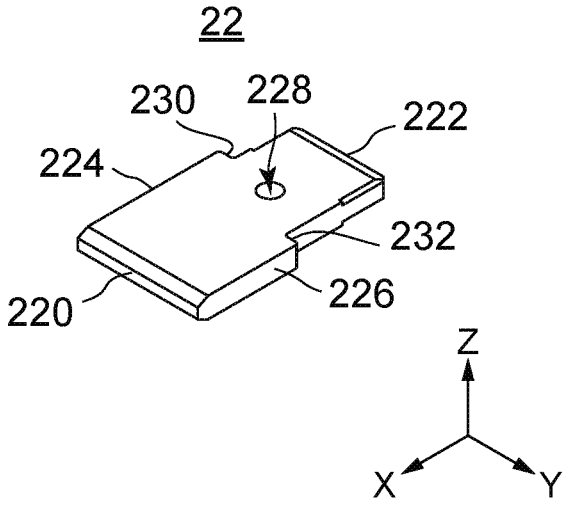
FIG. 9 is a front, perspective view showing a fixed contact included in the connector of FIG. 8.
Figure 10:
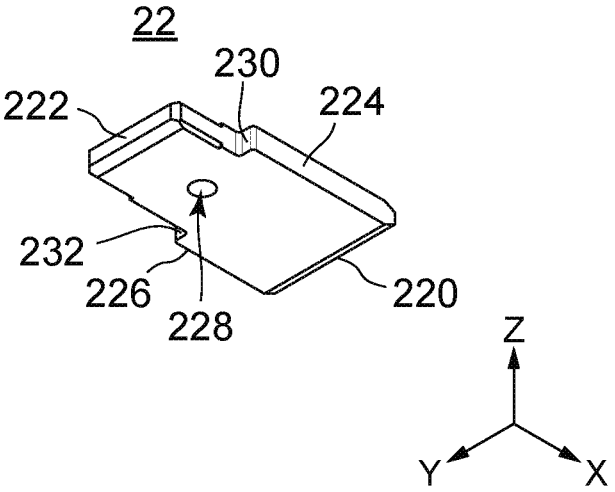
FIG. 10 is a rear, perspective view showing the fixed contact of FIG. 9.

Referring to FIGS. 9 and 10, each of the fixed contacts 22 has a roughly rectangular board shape. The fixed contact 22 is made of a metal plate. The fixed contact 22 has a front edge portion 220, a rear edge portion 222 and a pair of side portions 224 and 226. Moreover, a part of the fixed contact 22 is used as a gripped portion as mentioned later. In other words, the fixed contact 22 has the gripped portion. In addition, the fixed contact 22 is provided with a fixed hole 228 piercing therethrough in the up-down direction. Each of the front edge portion 220 and the rear edge portion 222 is subjected to a tapering process. In detail, a size of the front edge portion 220 in the up-down direction gradually decreases toward the front. A size of the rear edge portion 222 in the up-down direction gradually decreases toward the back. On the other hand, in the lateral direction, a size of the rear edge portion 222 is smaller than a size of the front edge portion 220. Thus, in the side portions 224 and 226 of the fixed contact 22, first and second step portions 230 and 232 are formed, respectively. In the front-rear direction, a position of the first step portion 230 and a position of the second step portion 232 are different from each other. Accordingly, when the fixed contact 22 is inserted into the fixed housing 24 in a wrong direction, it can be found.

Figure 11:
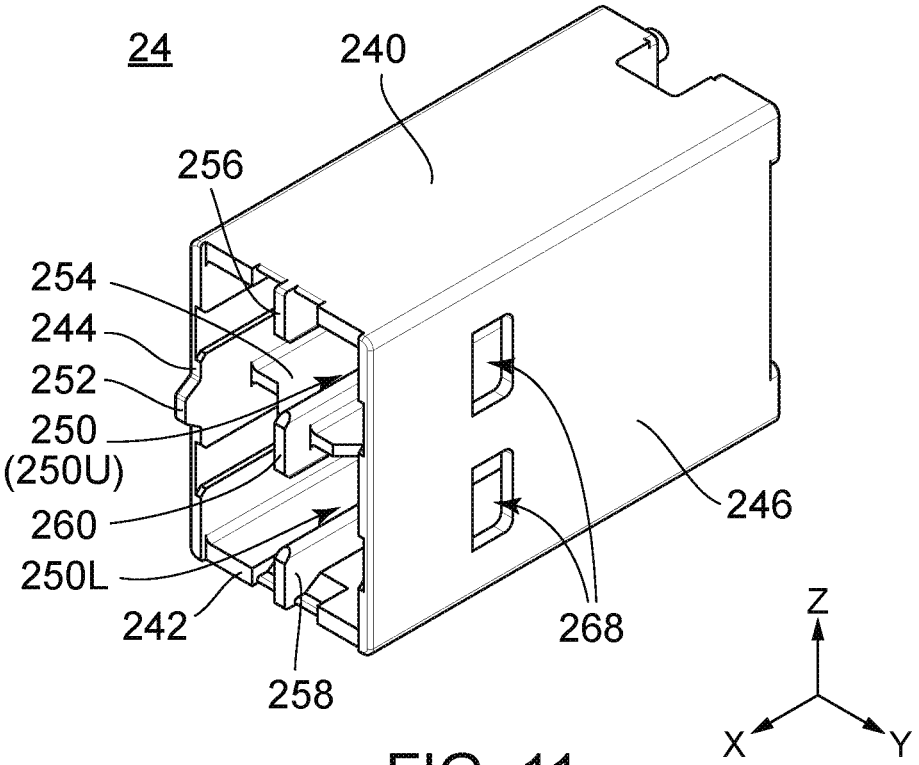
FIG. 11 is a front, perspective view showing a fixed housing included in the connector of FIG. 5.
Figure 12:
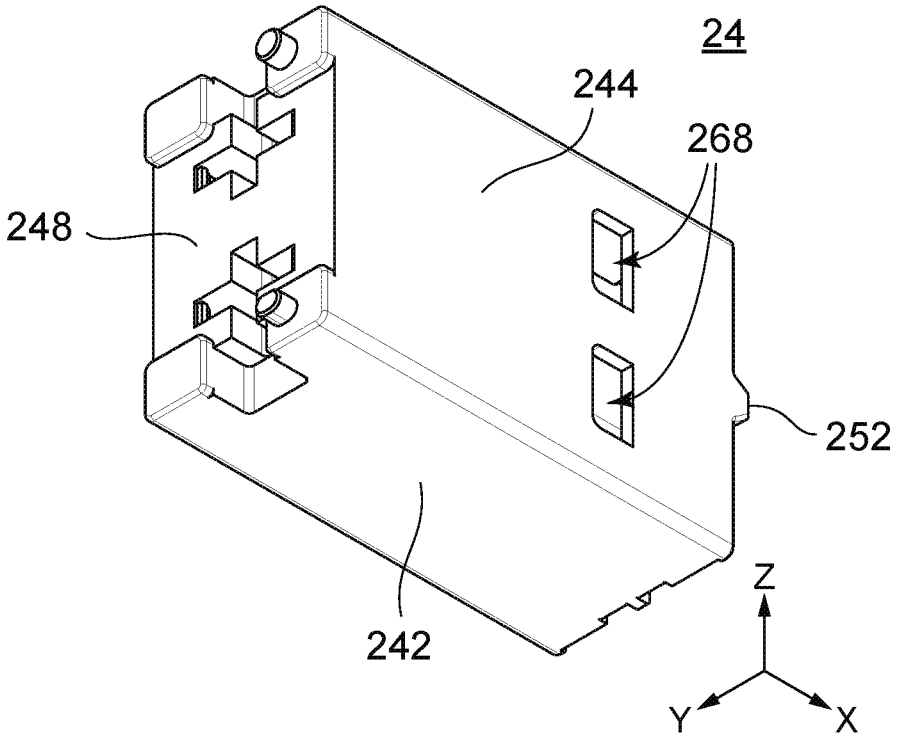
FIG. 12 is a rear, perspective view showing the fixed housing of FIG. 11.

Referring to FIGS. 11 and 12, the fixed housing 24 has an external form of a roughly rectangular parallelepiped. The fixed housing 24 is made of an insulating resin. The fixed housing 24 has an upper wall 240, a lower wall 242, a pair of sidewalls 244 and 246 and a rear wall 248. The upper wall 240, the lower wall 242, the sidewalls 244 and 246 and the rear wall 248 define an inner space 250 opening forward. A front edge of the sidewall 244 is formed with a protrusion 252. The protrusion 252 is positioned, in the up-down direction, in the middle of the front edge of the sidewall 244.

Figure 13:
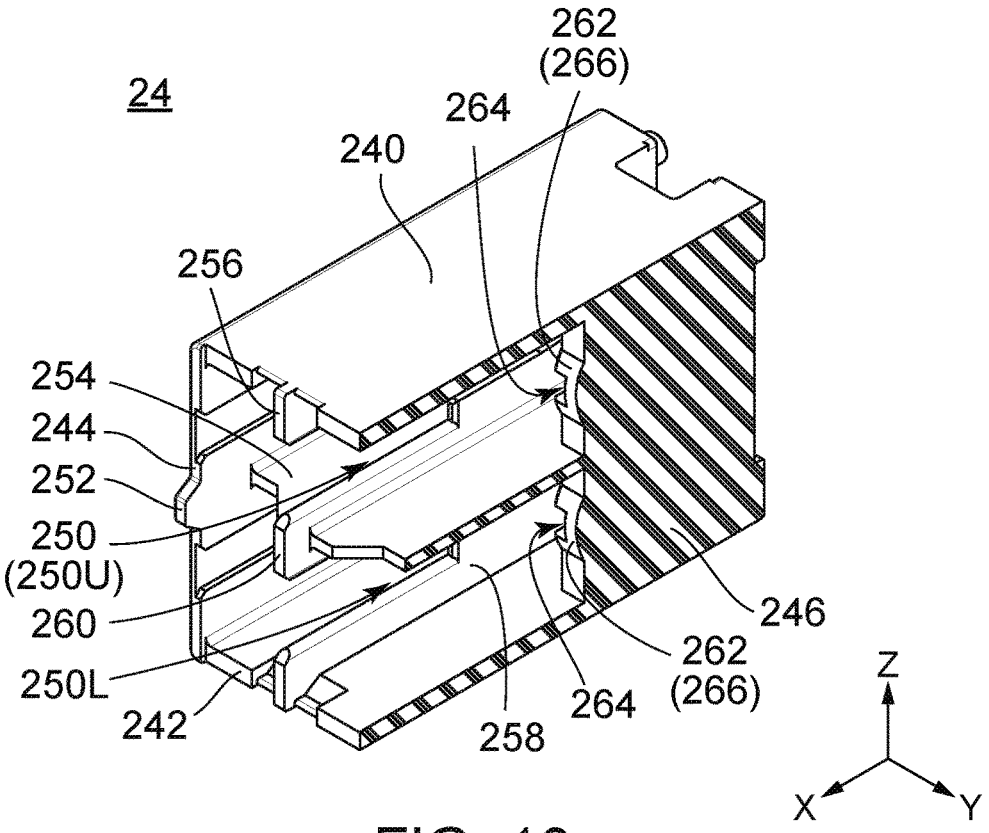
FIG. 13 is a perspective, cross-sectional view showing the fixed housing of FIG. 11.

As understood from FIG. 13, the inner space 250 of the fixed housing 24 is divided into two by a partition wall 254. In detail, the inner space 250 is divided into an upper-side inner space 250U and a lower-side inner space 250L. As understood from FIGS. 13 to 15, the partition wall 254 is connected to the sidewalls 244 and 246 and the rear wall 248 and supported by them.

Figure 15:
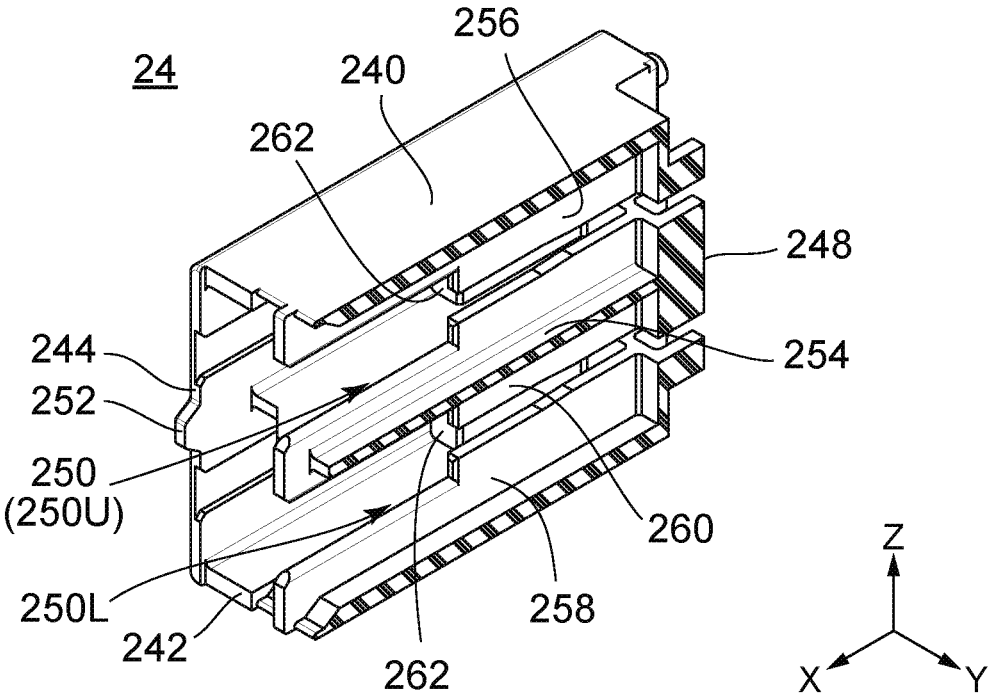
FIG. 15 is yet another perspective, cross-sectional view showing the fixed housing of FIG. 11.
Figure 17:
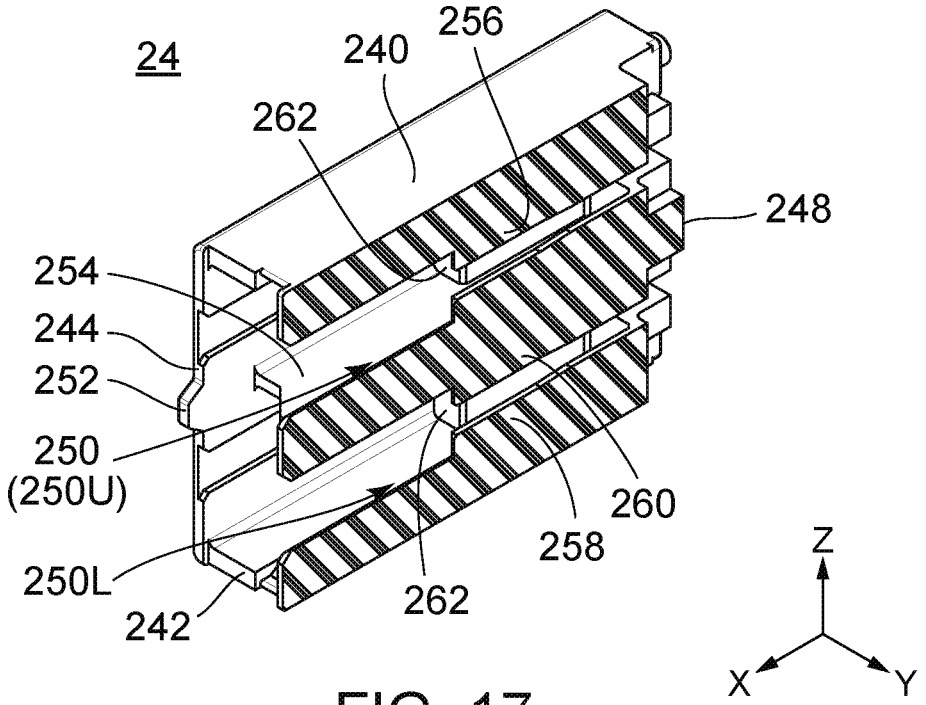
FIG. 17 is further still another perspective, cross-sectional view showing the fixed housing of FIG. 11.

Referring to FIGS. 13, 15 and 17, the upper wall 240 is formed with a partition board 256 protruding downward. The partition board 256 is positioned in the middle of the upper wall 240 in the lateral direction and extends along the front-rear direction. The partition board 256 consists of two parts, a front part and a rear part, which are contiguous to each other in the front-rear direction. In the up-down direction, a size of the front part of the partition board 256 is smaller than a size of the rear part of the partition board 256. Similarly, the lower wall 242 is formed with a partition board 258 protruding upward. The partition board 258 is positioned in the middle of the lower wall 242 in the lateral direction and extends along the front-rear direction. The partition board 258 consists of two parts, a front part and a rear part, which are contiguous to each other in the front-rear direction. In the up-down direction, a size of the front part of the partition board 258 is smaller than a size of the rear part of the partition board 258.

Referring to FIGS. 13 and 15 to 17, the partition wall 254 is formed with a partition board 260 protruding upward and downward. The partition board 260 is positioned in the middle of the partition wall 254 in the lateral direction and extends along the front-rear direction. The partition board 260 consists of two parts, a front part and a rear part, which are contiguous to each other in the front-rear direction. In the up-down direction, a size of the front part of the partition board 260 is smaller than a size of the rear part of the partition board 260.

Figure 8:
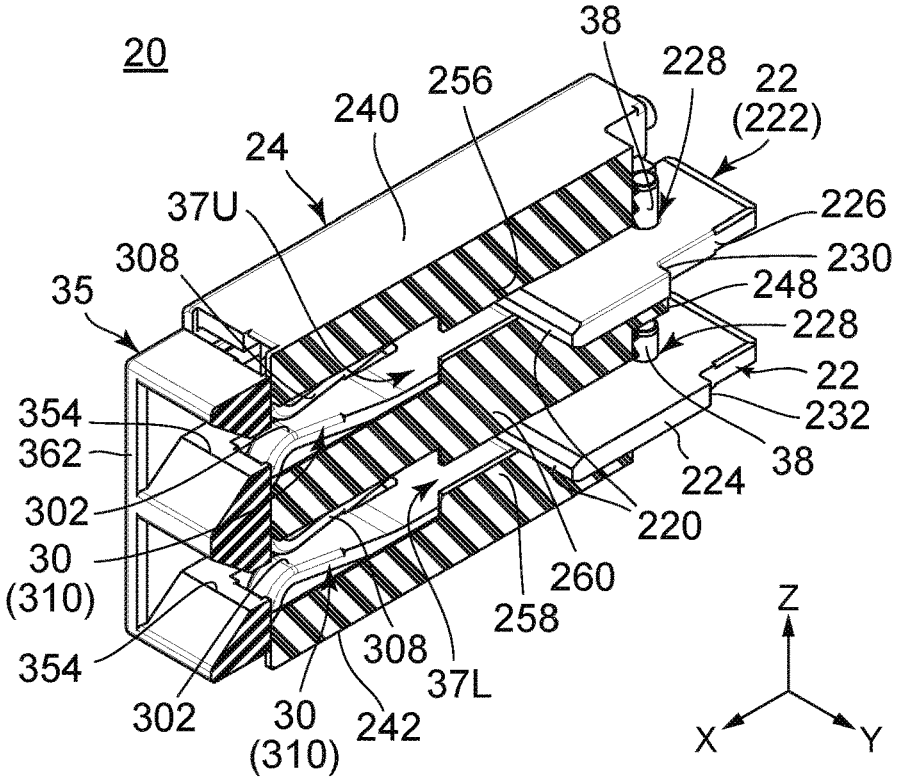
FIG. 8 is still another perspective, cross-sectional view showing the connector of FIG. 5.

As understood from FIG. 8, the partition board 256 and the partition board 260 face each other with a space left therebetween in the up-down direction. In the up-down direction, a distance dimension between the rear part of the partition board 256 and the rear part of the partition board 260 is slightly larger than an up-down directional size of the fixed contact 22. In the up-down direction, a distance dimension between the front part of the partition board 256 and the front part of the partition board 260 is larger than the distance dimension between the rear part of the partition board 256 and the rear part of the partition board 260. Similarly, the partition board 258 and the partition board 260 face each other with a space left therebetween in the up-down direction. In the up-down direction, a distance dimension between the rear part of the partition board 258 and the rear part of the partition board 260 is slightly larger than the up-down directional size of the fixed contact 22. In the up-down direction, a distance dimension between the front part of the partition board 258 and the front part of the partition board 260 is larger than the distance dimension between the rear part of the partition board 258 and the rear part of the partition board 260. With this structure, the fixed contact 22 can be inserted into each of between the partition board 256 and the partition board 260 and between the partition board 258 and the partition board 260.

Figure 14:
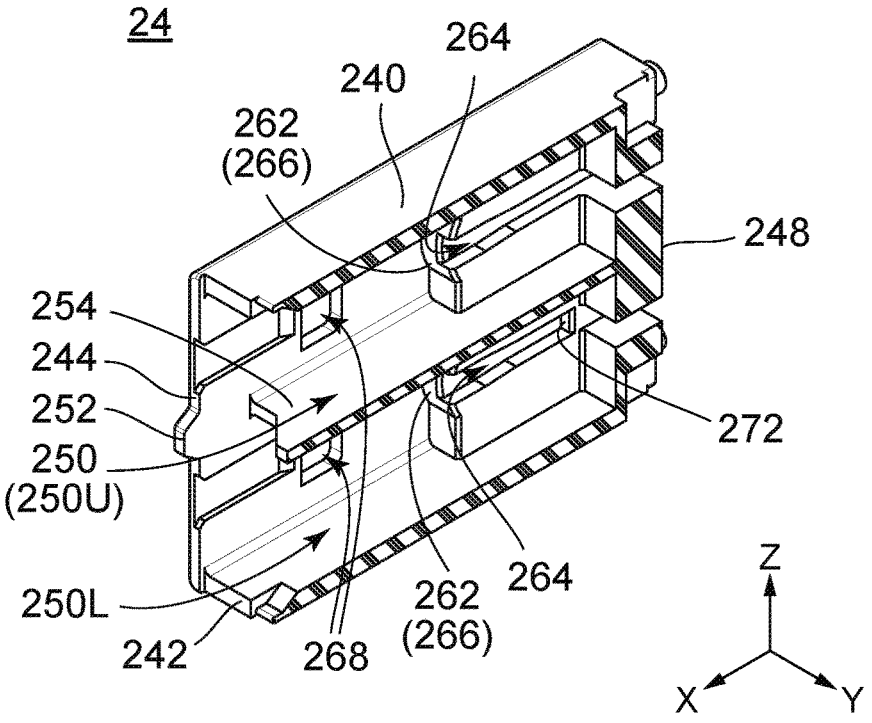
FIG. 14 is another perspective, cross-sectional view showing the fixed housing of FIG. 11.

As shown in FIG. 14, a rear part of the sidewall 244 is formed with two fixed contact supporting portions 262 protruding inward in the lateral direction. These fixed contact supporting portions 262 protrude into the upper-side inner space 250U and the lower-side inner space 250L, respectively.

As shown in FIG. 13, a rear part of the sidewall 246 is also formed with fixed contact supporting portions 262 protruding inward in the lateral direction. These fixed contact supporting portions 262 also protrude into the upper-side inner space 250U and the lower-side inner space 250L, respectively.

As shown in FIGS. 13 and 14, each of the fixed contact supporting portions 262 formed on the sidewalls 244 and 246 is provided with a groove 264 extending along the front-rear direction in the middle thereof in the up-down direction. An up-down directional size of the groove 264 is larger than the up-down directional size of the fixed contact 22. With this structure, the groove 264 can receive a part of the side portion 224 or 226 of the fixed contact 22. Moreover, at least a part of a front surface of the fixed contact supporting portion 262 forms a round portion (a first regulating portion) 266 protruding forward.

As shown in FIGS. 11 and 12, each of the sidewalls 244 and 246 is further provided with two apertures (second regulating portions) 268. As understood from FIGS. 14 and 16, each of the apertures 268 pierces the sidewall 244 or 246 in the lateral direction. However, the present invention is not limited thereto. Each of the sidewalls 244 and 246 may have, instead of the apertures 268, recesses which are formed in a lateral directional inner surface thereof and recessed outward in the lateral direction.

Figure 16:
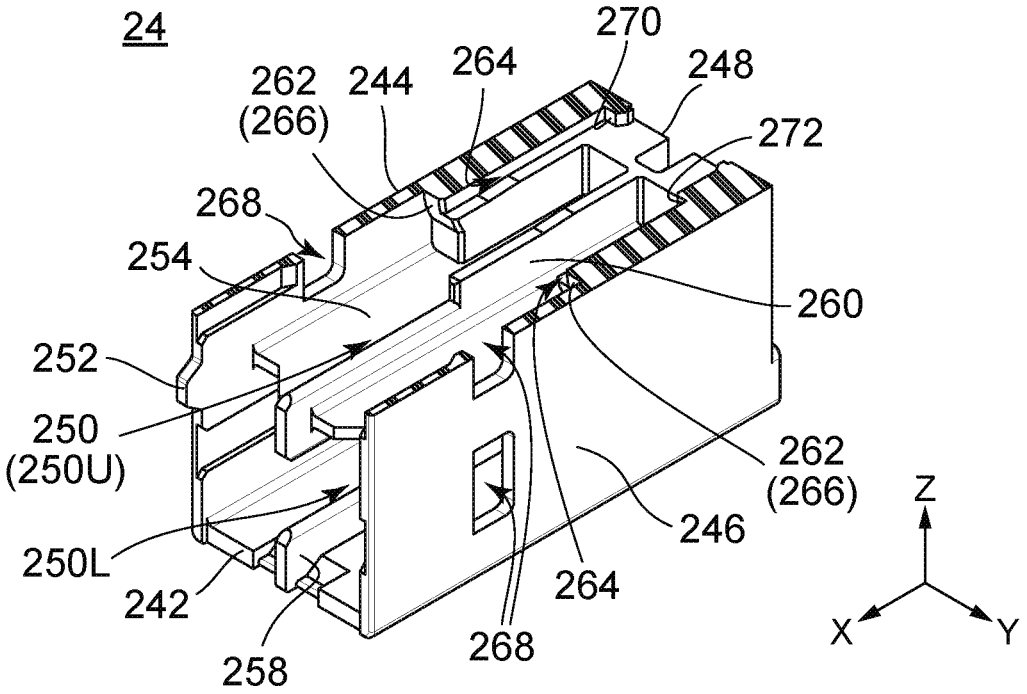
FIG. 16 is still another perspective, cross-sectional view showing the fixed housing of FIG. 11.

Referring to FIG. 16, the rear wall 248 is formed with a first butted portion 270 facing the upper-side inner space 250U. Moreover, the sidewall 246 is formed with a second butted portion 272 facing the upper-side inner space 250U. The rear wall 248 is further formed with a first butted portion (not shown) facing the lower-side inner space 250L. In addition, as shown in FIG. 14, the sidewall 244 is formed with a second butted portion 272 facing the lower-side inner space 250L. As understood from a positional relationship between the second butted portion 272 of the sidewall 244 and the second butted portion 272 of the sidewall 246, the first butted portion (not shown) formed on the rear wall 248 and facing the lower-side inner space 250L is positioned, in the lateral direction, opposite the first butted portion 270 facing the upper-side inner space 250U.

Figure 18:
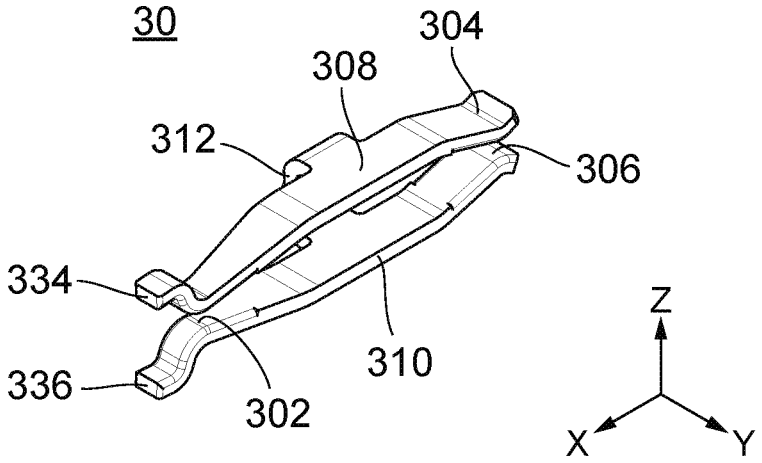
FIG. 18 is a front, perspective view showing a first contact member included in the connector of FIG. 7.
Figure 19:
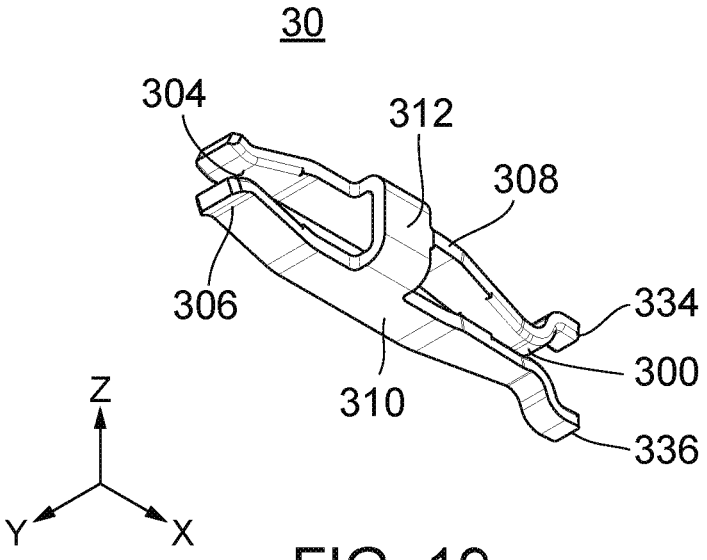
FIG. 19 is a rear, perspective view showing the first contact member of FIG. 18.
Figure 20:
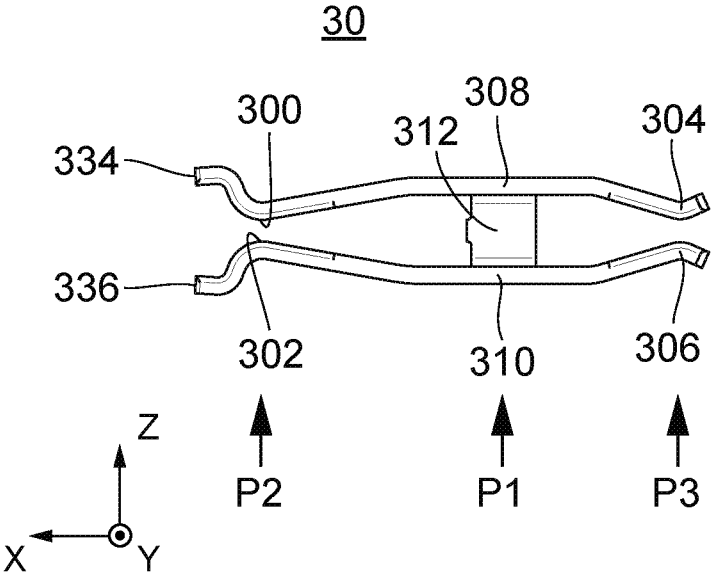
FIG. 20 is a side view showing the first contact member of FIG. 18.
Figure 21:
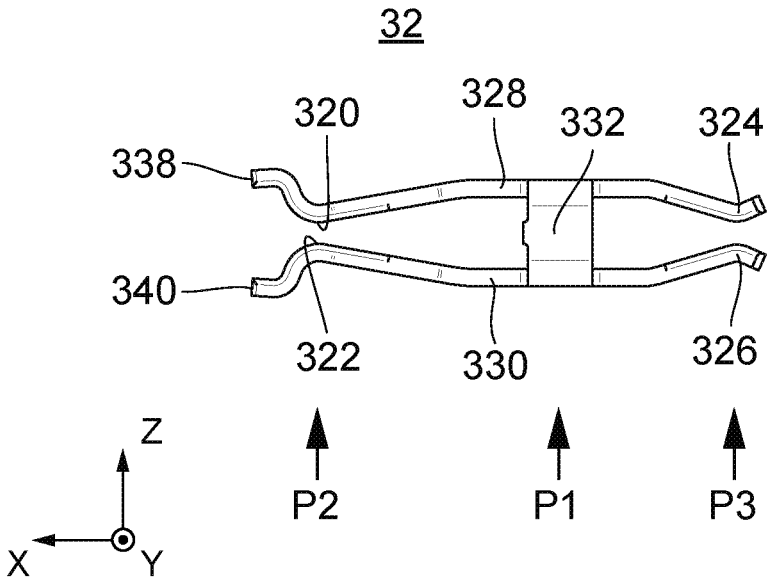
FIG. 21 is a side view showing a second contact member included in the connector of FIG. 7.

As shown in FIGS. 18 to 20, the first contact member 30 has an upper-side contact point 300, a lower-side contact point 302, an upper-side gripping section 304, a lower-side gripping section 306, an upper spring piece 308, a lower spring piece 310 and a joining section 312. As understood from FIGS. 21 to 24, the second contact member 32 is equal to one obtained by vertically reversing the first contact member 30. That is, as shown in FIG. 21, the second contact member 32 has an upper-side contact point 320, a lower-side contact point 322, an upper-side gripping section 324, a lower-side gripping section 326, an upper spring piece 328, a lower spring piece 330 and a joining section 332. Each of the first and the second contact members 30 and 32 may be formed by punching out a single metal plate and bending the punched out metal plate.

Figure 22:
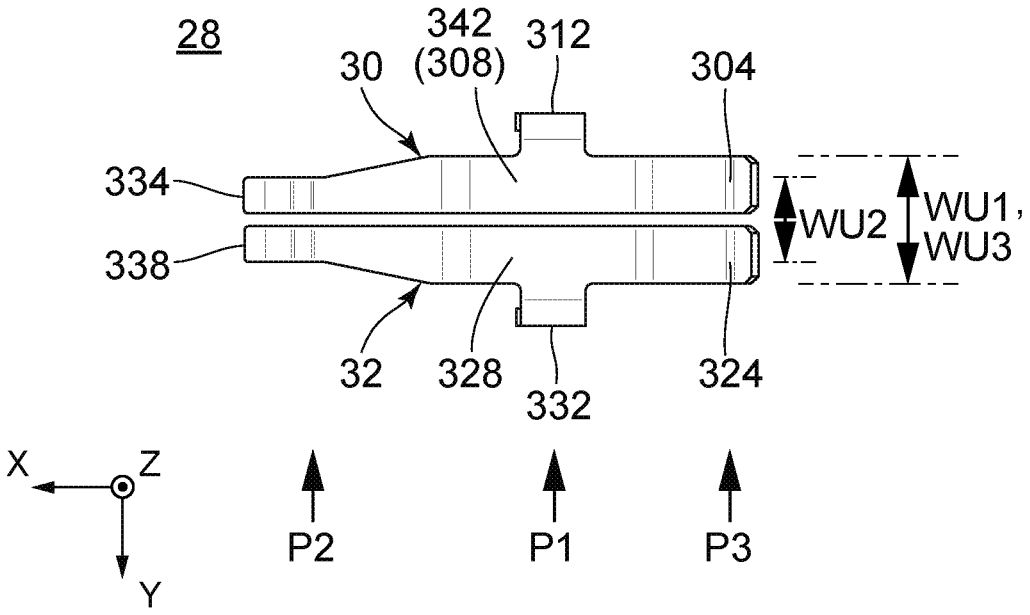
FIG. 22 is a plan view showing a movable contact which consists of the first contact member of FIG. 18 and the second contact member of FIG. 21.
Figure 23:
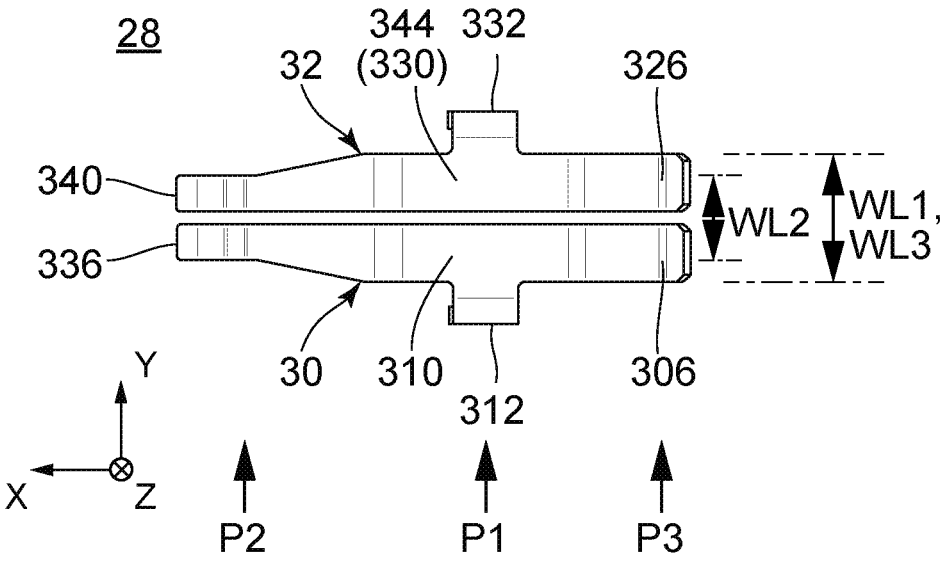
FIG. 23 is a bottom plan view showing the movable contact of FIG. 22.
Figure 24:
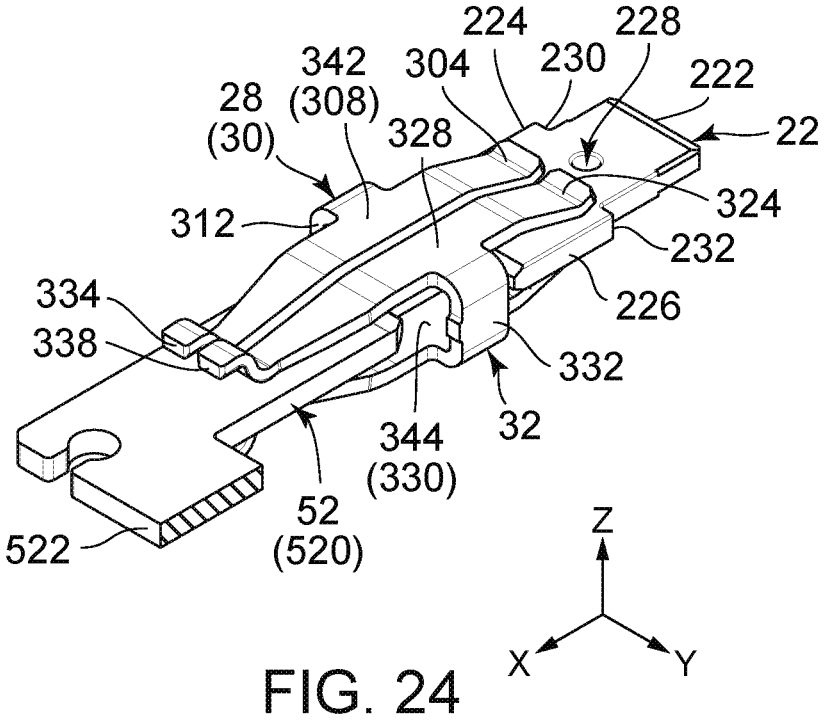
FIG. 24 is a perspective view showing the movable contact of FIG. 22 and the fixed contact of FIG. 9. The fixed contact is gripped by an upper-side gripping section and a lower-side gripping section of the movable contact. The movable contact is connected to a busbar included in the mating connector used to form the connector assembly of FIG. 1.

As shown in FIGS. 22 to 24, the first contact member 30 and the second contact member 32 constitute one movable contact 28 (by these two members). The upper spring piece 308 of the first contact member 30 and the upper spring piece 328 of the second contact member 32 constitute an upper-side spring part 342. Moreover, the lower spring piece 310 of the first contact member 30 and the lower spring piece 330 of the second contact member 32 constitute a lower-side spring part 344. Additionally, in the present embodiment, the movable contact 28 is composed of a combination of the first contact member 30 and the second contact member 32. However, the present invention is not limited thereto. The movable contact 28 may be composed of a single contact member (not shown). In such a case, the movable contact 28 may employ a structure in which the first contact member 30 and the second contact member 32 are partly joined to each other. For example, a structure in which the lower spring piece 310 of the first contact member 30 and the lower spring piece 330 of the second contact member 32 are partly joined to each other can be employed. Alternatively, a structure in which the upper spring piece 308 of the first contact member 30 and the upper spring piece 328 of the second contact member 32 are partly joined to each other may be employed. At any rate, it is enough that the movable contact 28 has two upper-side contact points, two lower-side contact points, an upper-side gripping section, a lower-side gripping section, an upper-side spring part, a lower-side spring part and two joining sections.

As understood from FIGS. 18 to 20, the upper spring piece 308 of the first contact member 30 has a shape long in the front-rear direction. The upper-side contact point 300 is formed in the vicinity of a front end (a first front end) 334 of the upper spring piece 308. In addition, the upper-side gripping section 304 is formed in a rear end portion of the upper spring piece 308. The upper spring piece 308 extends frontward-diagonally downward from the middle portion thereof toward the upper-side contact point 300. The upper spring piece 308 also extends backward-diagonally downward from the middle portion thereof toward the upper-side gripping section 304. Thus, the upper spring piece 308 supports the upper-side contact point 300 and the upper-side gripping section 304. Moreover, the lower spring piece 310 of the first contact member 30 has a shape symmetrical to the upper spring piece 308. In detail, the lower-side contact point 302 is formed in the vicinity of a front end (a second front end) 336 of the lower spring piece 310. In addition, the lower-side gripping section 306 is formed in a rear end portion of the lower spring piece 310. The lower spring piece 310 extends forward-diagonally upward from the middle portion thereof toward the lower-side contact point 302. The lower spring piece 310 also extends backward-diagonally upward from the middle portion thereof toward the lower-side gripping section 306. Thus, the lower spring piece 310 supports the lower-side contact point 302 and the lower-side gripping section 306. The upper-side contact point 300 and the lower-side contact point 302 face each other in the up-down direction. Similarly, the upper-side gripping section 304 and the lower-side gripping section 306 face each other in the up-down direction. In the up-down direction, a distance dimension between the front end 334 of the upper spring piece 308 and the front end 336 of the lower spring piece 310 is larger than a distance dimension between the upper-side contact point 300 and the lower-side contact point 302. With this, the busbar 52 can be easily guided between the upper-side contact point 300 and the lower-side contact point 302. Each of the upper spring piece 308 and the lower spring piece 310 is resiliently deformable. Owing to resilient deformation of the upper spring piece 308, the upper-side contact point 300 is movable at least in the up-down direction. Moreover, owing to resilient deformation of the lower spring piece 310, the lower-side contact point 302 is movable at least in the up-down direction.

As understood from FIG. 21, the upper spring piece 328 of the second contact member 32 extends forward-diagonally downward from the middle portion thereof toward the upper-side contact point 320. The upper spring piece 328 also extends backward-diagonally downward from the middle portion thereof toward the upper-side gripping section 324. Thus, the upper spring piece 328 of the second contact member 32 supports the upper-side contact point 320 and the upper-side gripping section 324. Moreover, the lower spring piece 330 extends forward-diagonally upward from the middle portion thereof toward the lower-side contact point 322. The lower spring piece 330 also extends backward-diagonally upward from the middle portion thereof toward the lower-side gripping section 326. Thus, the lower spring piece 330 of the second contact member 32 supports the lower-side contact point 322 and the lower-side gripping section 326. The upper-side contact point 320 and the lower-side contact point 322 face each other in the up-down direction. Similarly, the upper-side gripping section 324 and the lower-side gripping section 326 face each other in the up-down direction. The upper spring piece 328 has a front end (a first front end) 338 while the lower spring piece 330 has a front end (a second front end) 340. A distance dimension between the front end 338 of the upper spring piece 328 and the front end 340 of the lower spring piece 330 is larger than a distance dimension between the upper-side contact point 320 and the lower-side contact point 322. With this, the busbar 52 can be easily guided between the upper-side contact point 320 and the lower-side contact point 322. Each of the upper spring piece 328 and the lower spring piece 330 is resiliently deformable. Owing to resilient deformation of the upper spring piece 328, the upper-side contact point 320 is movable at least in the up-down direction. Moreover, owing to resilient deformation of the lower spring piece 330, the lower-side contact point 322 is movable at least in the up-down direction. The upper spring piece 328 and the lower spring piece 330 of the second contact member 32 are resiliently deformable independently of the upper spring piece 308 and the lower spring piece 310 of the first contact member 30. Therefore, the upper-side contact point 320 and the lower-side contact point 322 of the second contact member 32 are movable independently of the upper-side contact point 300 and the lower-side contact point 302 of the first contact member 30.

As mentioned above, in the present embodiment, the upper spring piece 308 of the first contact member 30 and the upper spring piece 328 of the second contact member 32 constitute the upper-side spring part 342. Moreover, the lower spring piece 310 of the first contact member 30 and the lower spring piece 330 of the second contact member 32 constitute the lower-side spring part 344. Then, the upper-side spring part 342 supports the upper-side contact points 300 and 320 and the upper-side gripping sections 304 and 324 while the lower-side spring part 344 supports the lower-side contact points 302 and 322 and the lower-side gripping sections 306 and 326. However, the present invention is not limited thereto. The movable contact 28 may be composed of a single contact member. The two upper-side contact points and the two lower-side contact points may be supported by the upper-side spring part and the lower-side spring part so that the upper-side contact points face the lower-side contact points, respectively in the up-down direction, and vice versa. In this case, these upper-side contact points and these lower-side contact points are supported by the upper-side spring part and the lower-side spring part so as to be movable independently of one another.

As shown in FIGS. 18 to 20, the joining section 312 of the first contact member 30 joins the upper spring piece 308 and the lower spring piece 310 to each other. In detail, the joining section 312 joins, in the lateral direction, one of side portions of the upper spring piece 308 and one of side portions of the lower spring piece 310 to each other. As understood from FIG. 20, the joining section 312 is positioned, in the front-rear direction, at a first position P1 positioned rearward of the middle of the first contact member 30. At a front edge of the joining section 312, a protrusion protruding forward is formed. As understood from FIGS. 18 to 20, a size of the joining section 312 of the first contact member 30 in the front-rear direction is smaller than a size of the upper spring piece 308 and the lower spring piece 310 in the front-rear direction. Moreover, a size of the joining section 312 in the up-down direction is smaller than the size of the upper spring piece 308 and the lower spring piece 310 in the front-rear direction. Furthermore, as understood from FIGS. 22 and 23, a size of the joining section 312 in the front-rear direction is larger than a size of the upper spring piece 308 and the lower spring piece 310 in the lateral direction. By designing the up-down directional size of the joining section 312 to be smaller and by designing the front-rear directional size of the joining section 312 to be larger, strength of the joining section 312 is enhanced to be stronger than strength of the upper spring piece 308 or the lower spring piece 310. With this, when the connector 20 and the mating connector 50 are mated with each other, the upper spring piece 308 and the lower spring piece 310 are allowed to be resiliently deformed, and the joining section 312 can be prevented from deforming.

As shown in FIG. 21, the joining section 332 of the second contact member 32 joins the upper spring piece 328 and the lower spring piece 330 to each other. In detail, the joining section 332 joins, in the lateral direction, one of side portions of the upper spring piece 328 and one of side portions of the lower spring piece 330 to each other. As understood from FIG. 21, the joining section 332 is positioned, in the front-rear direction, at the first position P1 positioned rearward of the middle of the second contact member 32. As understood from FIG. 21, a size of the joining section 332 of the second contact member 32 in the front-rear direction is smaller than a size of the upper spring piece 328 and the lower spring piece 330 in the front-rear direction. Moreover, a size of the joining section 332 in the up-down direction is smaller than the size of the upper spring piece 328 and the lower spring piece 330 in the front-rear direction. Furthermore, as understood from FIGS. 22 and 23, a size of the joining section 332 in the front-rear direction is larger than a size of the upper spring piece 328 and the lower spring piece 330 in the lateral direction. By designing the up-down directional size of the joining section 332 to be smaller and by designing the front-rear directional size of the joining section 332 to be larger, strength of the joining section 332 is enhanced to be stronger than strength of the upper spring piece 328 or the lower spring piece 330. With this, when the connector 20 and the mating connector 50 are mated with each other, the upper spring piece 328 and the lower spring piece 330 are allowed to be resiliently deformed, and the joining section 332 can be prevented from deforming.

As shown in FIGS. 20 and 21, the upper-side contact points 300 and 320 and the lower-side contact points 302 and 322 are positioned, in the front-rear direction, at a second position P2 positioned forward of the first position P1. The upper-side gripping sections 304 and 324 and the lower-side gripping sections 306 and 326 are positioned, in the front-rear direction, at a third position P3 positioned rearward of the first position P1. In the front-rear direction, a distance dimension between the first position P1 and the second position P2 is larger than a distance dimension between the first position P1 and the third position P3. This is in order to make resilient deformation of front parts of the upper spring pieces 308 and 328 and the lower spring pieces 310 and 330 relatively easy and to make resilient deformation of rear parts of them relatively difficult. In other words, this is in order to make movement of the upper-side contact points 300 and 320 and the lower-side contact points 302 and 322 relatively easy and to make movement of the upper-side gripping sections 304 and 324 and the lower-side gripping sections 306 and 326 relatively difficult.

As shown in FIG. 22, in the lateral direction, the upper-side spring part 342 is positioned between the two joining sections 312 and 332. As understood from FIGS. 20 to 22, the upper-side contact points 300 and 320 are also positioned between the two joining sections 312 and 332. In addition, in the lateral direction, the upper-side contact points 300 and 320 are positioned at positions closer to the middle. As mentioned later, this is in order to reduce spatial margins allowing movement of the upper-side contact points 300 and 320.

As shown in FIG. 22, in the lateral direction, the upper-side spring part 342 has an upper-side first width WU1 at the first position P1, an upper-side second width WU2 at the second position P2 and an upper-side third width WU3 at the third position P3. In the present embodiment, the upper-side first width WU1 and the upper-side third width WU3 are equal to each other. Then, a size of the upper-side second width WU2 is smaller than a size of the upper-side first WU1 and a size of the upper-side third WU3. This is in order to make the front parts of the upper spring pieces 308 and 328 relatively soft so that the movement of the upper-side contact points 300 and 320 (see FIGS. 20 and 21) becomes facilitated. Moreover, this is in order to make the rear parts of the upper spring pieces 308 and 328 relatively hard so that the movement of the upper-side gripping sections 304 and 324 becomes difficult.

The lower-side spring part 344 is formed similarly to the upper-side spring part 342. In detail, as shown in FIG. 23, in the lateral direction, the lower-side spring part 344 is positioned between two of the joining sections 312 and 332. As understood from FIGS. 20, 21 and 23, the lower-side contact points 302 and 322 are also positioned between two of the joining sections 312 and 332. In addition, in the lateral direction, the lower-side contact points 302 and 322 are positioned at positions closer to the middle. As mentioned later, this is in order to reduce spatial margins allowing movement of the lower-side contact points 302 and 322.

As shown in FIG. 23, in the lateral direction, the lower-side spring part 344 has a lower-side first width WL1 at the first position P1, a lower-side second width WL2 at the second position P2 and a lower-side third width WL3 at the third position P3. In the present embodiment, the lower-side first width WL1 and the lower-side third width WL3 are equal to each other. Then, a size of the lower-side second width WL2 is smaller than a size of the first lower WL1 and the third lower WL3. This is in order to make the front parts of the lower spring pieces 310 and 330 relatively soft so that the movement of the lower-side contact points 302 and 322 (see FIGS. 20 and 21) becomes facilitated. Moreover, this is in order to make the rear parts of the lower spring pieces 310 and 330 relatively hard so that the movement of the lower-side gripping sections 306 and 326 becomes difficult. Additionally, in the present embodiment, the lower-side first width WL1, the lower-side second width WL2 and the lower-side third width WL3 are equal to the upper-side first width WU1, the upper-side second width WU2 and the upper-side third width WU3, respectively. However, the lower-side first width WL1, the lower-side second width WL2 and the lower-side third width WL3 may be different from the upper-side first width WU1, the upper-side second width WU2 and the upper-side third width WU3, respectively.

Referring to FIGS. 25 to 28, the movable housing 35 has a frame portion 350 and two pairs of arm portions 352 extending rearward from the frame portion 350. The movable housing 35 is made of an insulating resin. Moreover, the frame portion 350 is provided with two opening portions 354. In other words, the movable housing 35 has the two opening portions 354. The opening portions 354 are juxtaposed with each other in the up-down direction. The number of the pairs of the arm portions 352 and the number of the opening portions 354 correspond to the number of the busbars 52 of the mating connector 50 (see FIG. 1).

Figure 25:
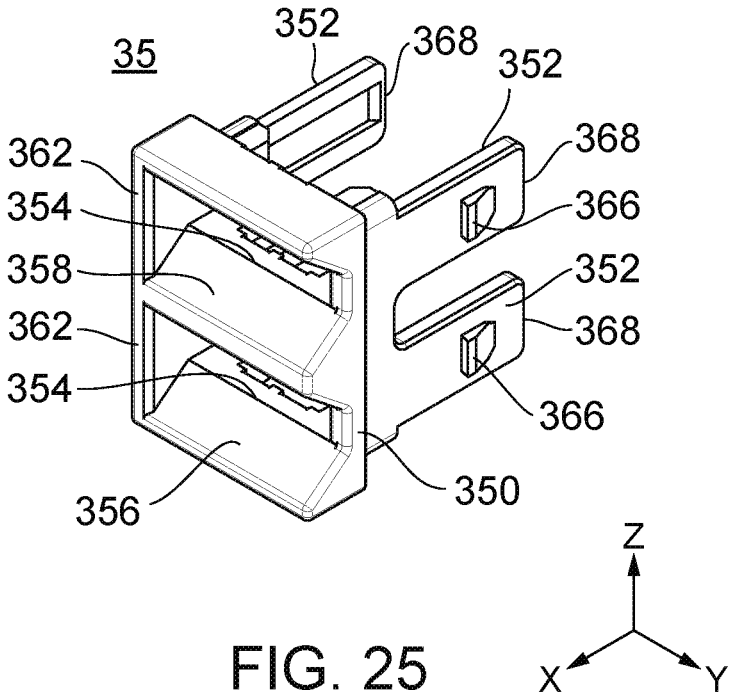
FIG. 25 is a front, perspective view showing a movable housing included in the connector of FIG. 5.
Figure 26:
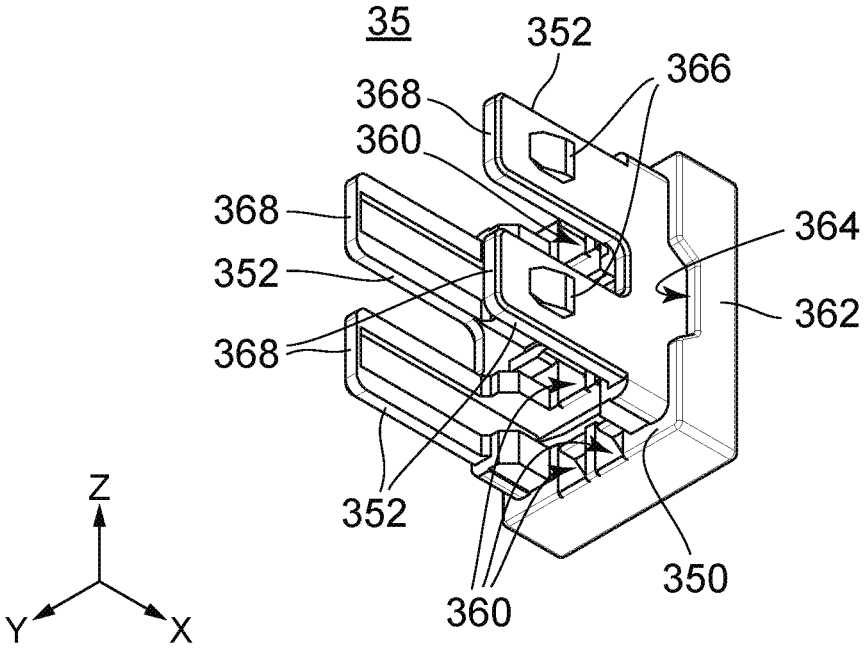
FIG. 26 is a rear, perspective view showing the movable housing of FIG. 25.
Figure 27:
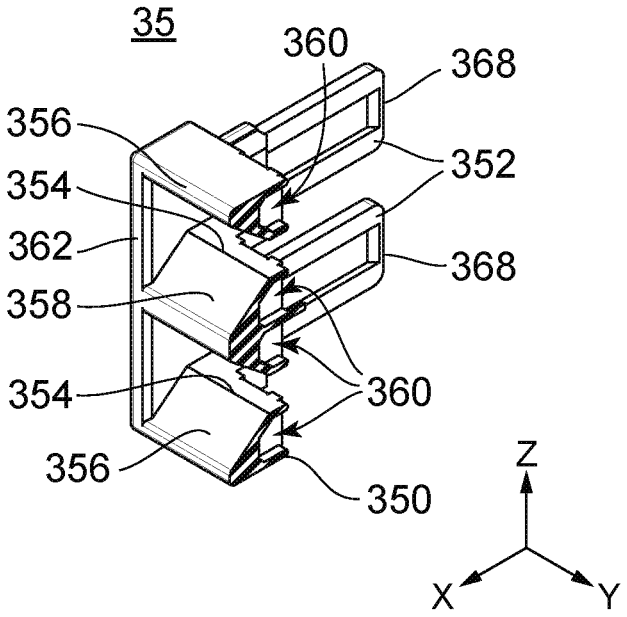
FIG. 27 is a perspective, cross-sectional view showing the movable housing of FIG. 25.

As shown in FIGS. 25 and 27, the frame portion 350 is provided with protruding portions 356 protruding forward from upper and lower edges thereof and a protruding portion 358 positioned between the two opening portions 354 and protruding forward in the front-rear direction. The protruding portions 356 and 358 extend in the lateral direction. Moreover, as shown in FIGS. 26 and 27, the protruding portions 356 and 358 are formed with receiving portions 360 recessed forward, respectively. Furthermore, as shown in FIGS. 25 to 27, the frame portion 350 is provided with a wall 362 protruding forward from ones of lateral directional edges of the opening portions 354. The frame portion 350 is not provided with a wall protruding forward from the others of the lateral directional edges of the opening portions 354. Furthermore, as shown in FIG. 26, the frame portion 350 is formed with a notch 364 recessed forward.

Figure 28:
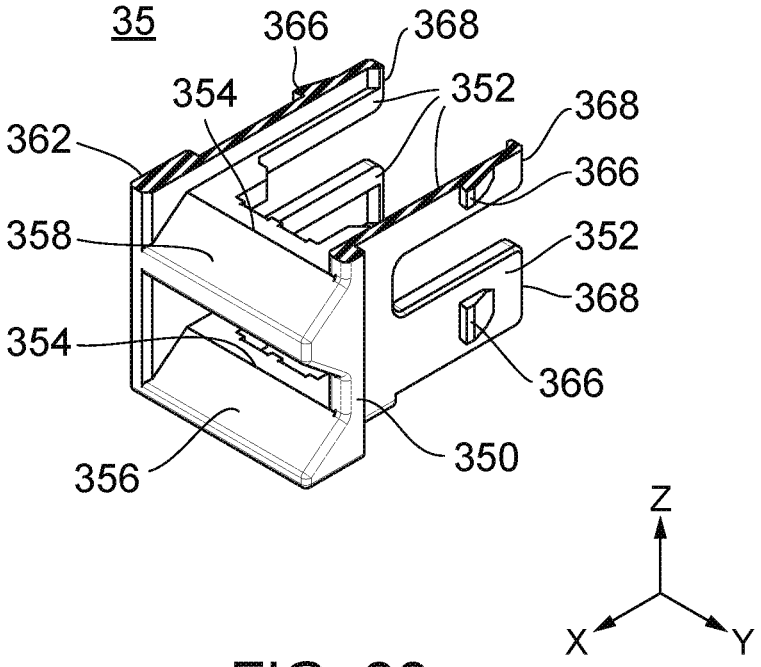
FIG. 28 is another perspective, cross-sectional view showing the movable housing of FIG. 25.

As shown in FIGS. 25, 26 and 28, each of the arm portions 352 is provided with a protrusion (a regulated portion) 366 protruding outward in the lateral direction. In other words, the arm portion 352 supports the protrusion 366. The protrusion 366 is formed so as to increase protrusion amount gradually from the back to the front. In other words, the protrusion 366 has an inclined plane inclined with respect to the lateral direction and the front-rear direction. At an end of the arm portion 352, an end surface (a third regulating portion) 368 perpendicular to the front-rear direction is formed. In other words, the arm portion 352 supports the end surface (the third regulating portion) 368. Thus, in the present embodiment, both of the protrusion (the regulated portion) 366 and the end surface (the third regulating portion) 368 are supported by the arm portion 352 of the movable housing 35. This structure can simplify the structure of the connector 20 and reduce a lateral directional size thereof.

Figure 29:
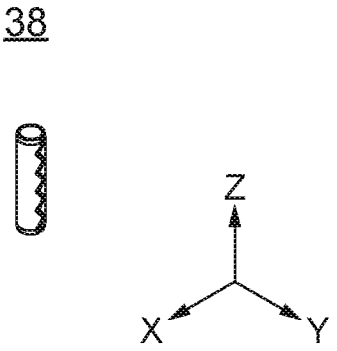
FIG. 29 is a perspective view showing a spring pin included in the connector of FIG. 8.
Figure 30:
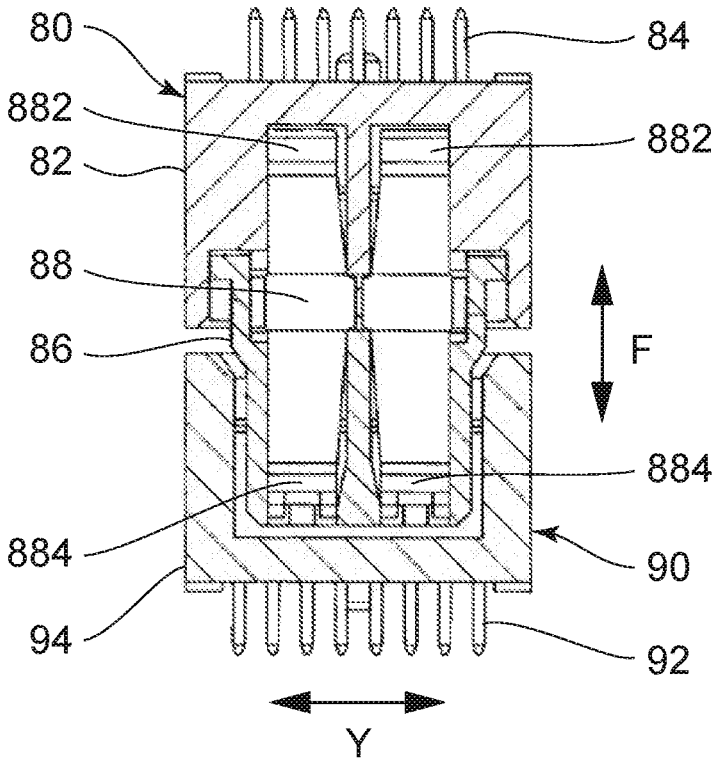
FIG. 30 PRIOR ART
FIG. 30 is a cross-sectional view of a connector and a mating connector disclosed in Patent Document 1. The connector and the mating connector are mated with each other.
Figure 31:
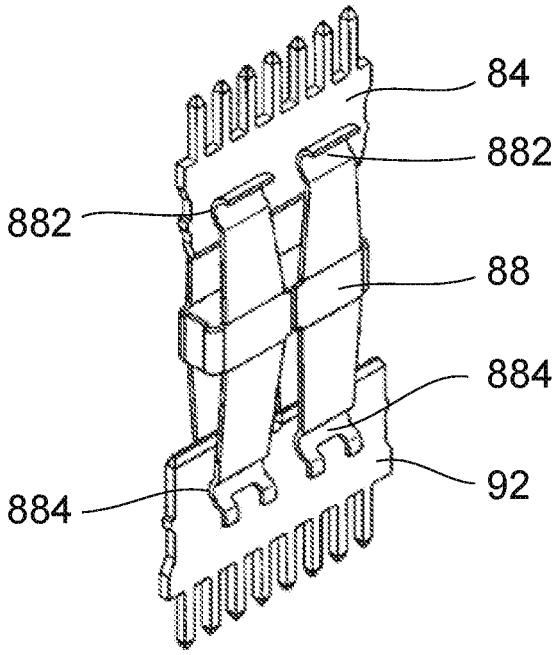
FIG. 31 PRIOR ART
FIG. 31 is a perspective view showing a fixed-side contact, a movable-side contact and a mating contact included in a combination of the connector and the mating connector of FIG. 30.

As shown in FIG. 29, the spring pin 38 has an approximately cylindrical shape. The spring pin 38 is formed by punching out a metal plate and bending it. An external diameter of the spring pin 38 is slightly larger than an internal diameter of the fixed hole 228 formed in the fixed contact 22.

As understood from FIG. 8, the fixed contacts 22 are fixed to and held by the fixed housing 24. In detail, each of the fixed contacts 22 is inserted into the upper-side inner space 250U or the lower-side inner space 250L (see FIGS. 13 to 17) of the fixed housing 24 from the front of the fixed housing 24. The two fixed contacts 22 are inserted into the upper-side inner space 250U and the lower-side inner space 250L of the fixed housing 24, respectively, in a state that they are mutually inverted upside down. Hereinafter, the description will be made about the fixed contact 22 inserted into the upper-side inner space 250U. The side portions 224 and 226 (see FIGS. 9 and 10) of the fixed contact 22 are received by the grooves 264 (see FIGS. 13, 14 and 16) of the fixed contact supporting portions 262 in part. The first and the second step portions 230 and 232 (see FIGS. 9 and 10) of the fixed contact 22 are brought into abutment with the first and the second butted portions 270 and 272 (see FIG. 16), respectively, so that rearward movement of the fixed contact 22 is regulated with respect to the fixed housing 24. In other words, the first and the second step portions 230 and 232 together with the first and the second butted portions 270 and 272 position the fixed contact 22 with respect to the fixed housing 24. In this state, when the spring pin 38 is press-fitted into the fixed hole 228, forward movement of the fixed contact 22 is regulated with respect to the fixed housing 24. Thus, the fixed contact 22 is fixed to and held by the fixed housing 24. In the state that the fixed contact 22 is fixed to the fixed housing 24, a part (the gripped portion) of the fixed contact 22 is positioned in the upper-side inner space 250U and extends forward. The fixed contact 22 inserted into the lower-side inner space 250L is similarly fixed to and held by the fixed housing 24.

Figure 5:
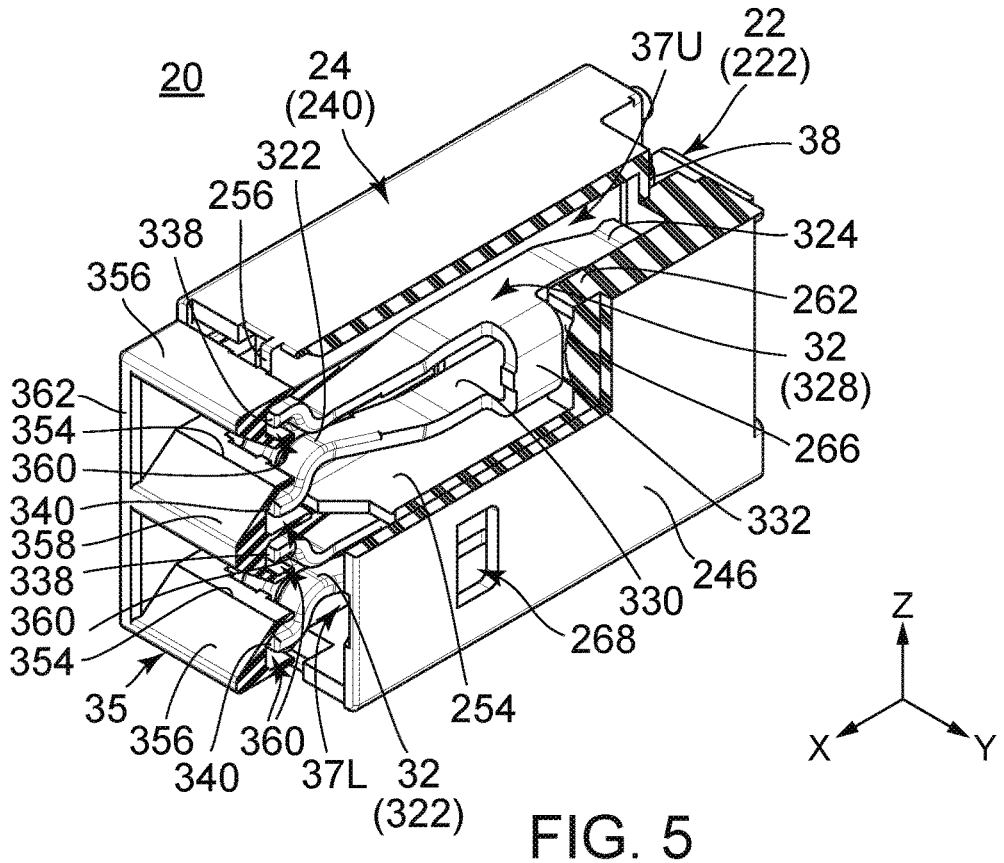
FIG. 5 is a perspective, cross-sectional view showing the connector included in the connector assembly of FIG. 1.

As understood from FIGS. 5 to 8, the movable contacts 28 are accommodated in the inner space 250 (see FIG. 13) of the fixed housing 24. Although the description will be made about the movable contact 28 accommodated in the upper-side inner space 250U hereinafter, the same is applied to the movable contact 28 accommodated in the lower-side inner space 250L. The first contact member 30 and the second contact member 32 which constitute the movable contact 28 are inserted into the upper-side inner space 250U from the front of the fixed housing 24. As shown in FIG. 5, the joining section 332 of the second contact member 32 is brought into abutment with the round portion 266 of the sidewall 246, so that the second contact member 32 is positioned with respect to the fixed housing 24. Similarly, the joining section 312 of the first contact member 30 is brought into abutment with the round portion 266 (see FIGS. 14 and 16) of the sidewall 244, so that the first contact member 30 is positioned with respect to the fixed housing 24. In other words, a pair of the round portions 266 functions as the first regulating portions which regulate rearward movement of the movable contact 28.

Figure 7:
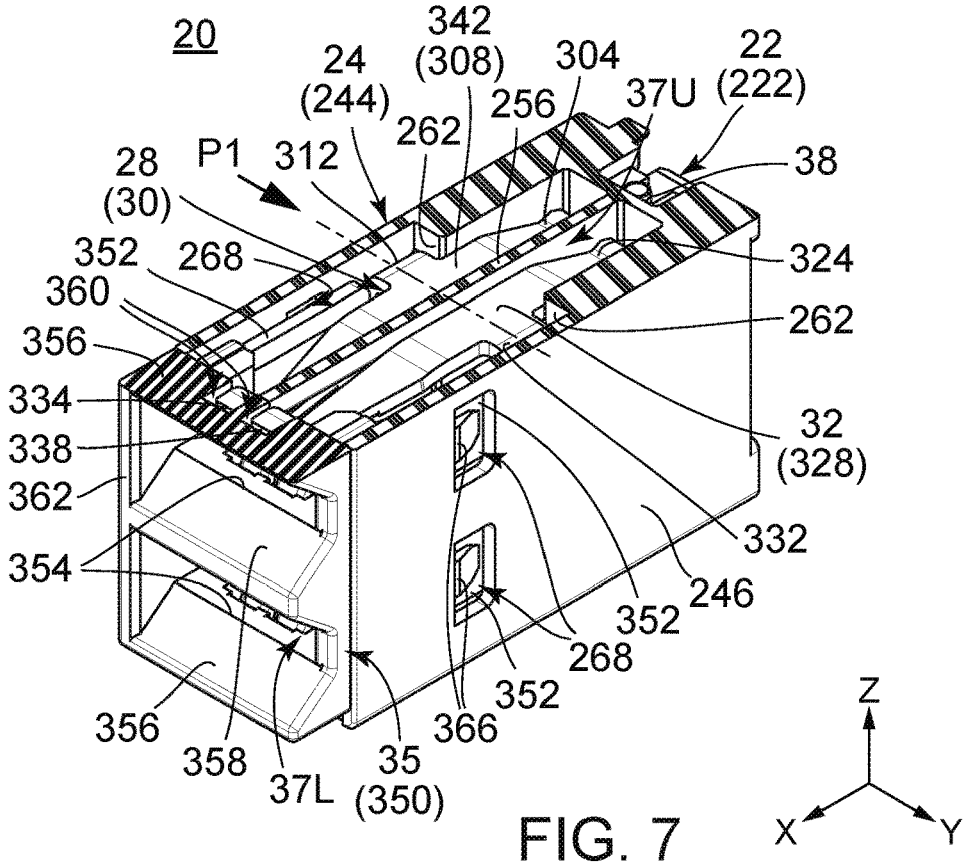
FIG. 7 is yet another perspective, cross-sectional view showing the connector of FIG. 5.

As shown in FIGS. 7 and 8, in the state that the first contact member 30 is positioned with respect to the fixed housing 24, the first contact member 30 is positioned between the sidewall 244 and the partition boards 256 and 260 at the first position P1. With this positioning, lateral directional movement of the first contact member 30 is regulated by a part of the sidewall 244 and parts of the partition boards 256 and 260, and an orientation of the first contact member 30 is maintained. In other words, the part of the sidewall 244 and the parts of the partition boards 256 and 260 function as a fourth regulating portion and a fifth regulating portion, respectively, which regulate the lateral directional movement of the first contact member 30. Similarly, the second contact member 32 is positioned between the sidewall 246 and the partition boards 256 and 260 at the first position P1. With this positioning, lateral directional movement of the second contact member 32 is regulated by a part of the sidewall 246 and parts of the partition boards 256 and 260, and an orientation of the second contact member 32 is maintained. In other words, the part of the sidewall 246 and the parts of the partition boards 256 and 260 function as a fourth regulating portion and a fifth regulating portion, respectively, which regulate the lateral directional movement of the second contact member 32.

As understood from FIG. 24, in a state that the movable contact 28 is accommodated in the upper-side inner space 250U of the fixed housing 24, the upper-side gripping section 304 and the lower-side gripping section 306 of the first contact member 30 and the upper-side gripping section 324 and the lower-side gripping section 326 of the second contact member 32 grip the part (the gripped portion) of the fixed contact 22 in the up-down direction. Thus, the movable contact 28 is accommodated in the upper-side inner space 250U. Similarly, the movable contact 28 inserted into the lower-side inner space 250L (see FIGS. 13 to 17) is accommodated in the lower-side inner space 250L.

As understood from FIGS. 5 to 8, the movable housing 35 is attached to a front part of the fixed housing 24. Since the arm portions 352 are resiliently deformable and the protrusions 366 have the inclined planes, the arm portions 352 can enter into the inner space 250 (see FIG. 11) from the front of the fixed housing 24. When the protrusions 366 reach the apertures 268 of the fixed housing 24, the protrusions 366 are positioned, at least in part, in the apertures 268 due to reaction forces of the arm portions 352. As understood from FIG. 2, the sidewall 244 is formed with the protrusion 252, and the movable housing 35 is formed with the notch 364. Accordingly, in a case where the movable housing 35 is inserted into the fixed housing 24 in a wrong direction, the protrusions 366 cannot reach the apertures 268. Thus, the movable housing 35 is prevented from being attached to the fixed housing 24 in the wrong direction.

As understood from FIGS. 5 to 8, when viewed along the lateral direction, a size of the aperture 268 is larger than a size of the protrusion 366. With this, the aperture 268 allows the protrusion 366 to move within a predetermined range at least in up-down direction. Moreover, an edge portion of the aperture 268 regulates the protrusion 366 so that the protrusion 366 does not move beyond the predetermined range at least in the up-down direction. That is, the aperture 268 functions as the second regulating portion which regulates the movement of the protrusion 366 beyond the predetermined range. Moreover, the edge portion of the aperture 268 regulates forward movement of the protrusion 366. In other words, the apertures 268 together with the protrusions 366 prevent the movable housing 35 from coming off from the fixed housing 24. Thus, the movable housing 35 is attached to the fixed housing 24 in a state that it is movable at least in the up-down direction. Additionally, in the present embodiment, the fixed housing 24 is formed with the apertures 268, and the arm portions 352 of the movable housing 35 are formed with the protrusions 366. However, the fixed housing 24 may be formed with protrusions, and the movable housing 35 may be formed with apertures or recesses corresponding thereto.

As understood from FIGS. 5 to 8, the movable housing 35 attached to the fixed housing 24, in cooperation with the fixed housing 24, defines an upper accommodation portion 37U and a lower accommodation portion 37L. The upper accommodation portion 37U is a part of the upper-side inner space 250U (see FIGS. 13 to 17) of the fixed housing 24, and the lower accommodation portion 37L is a part of the lower-side inner space 250L (see FIGS. 13 to 17) of the fixed housing 24. In a state that the movable housing 35 is attached to the fixed housing 24, each of the opening portions 354 of the movable housing 35 communicates with the upper accommodation portion 37U or the lower accommodation portion 37L and opens forward.

As understood from FIGS. 5 to 8, the two movable contacts 28 are accommodated in the upper accommodation portion 37U and the lower accommodation portion 37L, respectively. The gripped portions of the fixed contacts 22 gripped by the movable contacts 28 are also positioned in the upper accommodation portion 37U and the lower accommodation portion 37L, respectively. The orientations of the movable contacts 28 are maintained by the fixed housing 24 as mentioned before. In other words, the movable housing 35 is not concerned with maintenance of the orientations of the movable contacts 28. Accordingly, the movable housing 35 can be simplified in structure so that a protrusion amount of the movable housing 35 from the fixed housing 24 can be reduced in the front-rear direction. Large protrusion amount of the movable housing 35 tends to cause a problem, such as inappropriately tilting of the movable housing 35 with respect to the fixed housing 24, when the movable housing 35 receives an external force. In contrast with this, small protrusion amount of the movable housing 35 allows the movable housing 35 to move properly with respect to the fixed housing 24 in the up-down direction when the movable housing 35 receives the external force.

Figure 6:
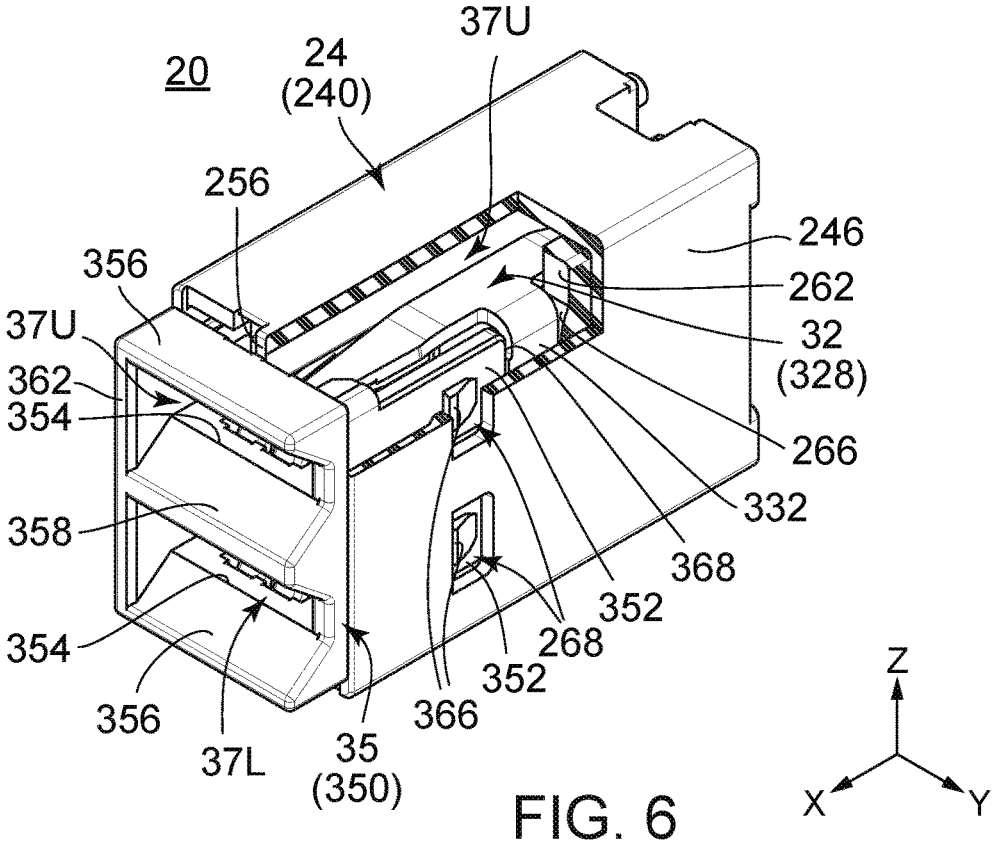
FIG. 6 is another perspective, cross-sectional view showing the connector of FIG. 5.

As shown in FIGS. 6 and 7, when the movable housing 35 is attached to the fixed housing 24, the end surfaces 368 (see FIGS. 25 to 27) of the arm portions 352 positioned in the upper-side inner space 250U (see FIGS. 13 to 17) are positioned forward of the joining sections 312 and 332. Then, the end surfaces 368 of the arm portions 352 regulate forward movement of the movable contact 28. Thus, the end surfaces 368 of the pair of the arm portions 352 regulate the forward movement of the movable contact 28. That is, the end surfaces 368 of the arm portions 352 function as the third regulating portions which regulate the forward movement of the movable contact 28. Similarly, the end surfaces 368 (see FIGS. 25 to 27) of the arm portions 352 in the lower-side inner space 250L (see FIGS. 13 to 17) also regulate forward movement of the other of the movable contacts 28. Thus, the joining sections 312 and 332 are positioned, in the front-rear direction, between the pair of the round portions (the first regulating portions) 266 and the pair of the end surfaces (the third regulating portions) 368 of the pair of the arm portions 352, and front-rear directional movement of thereof is regulated by them.

As shown in FIG. 5, when the movable housing 35 is attached to the fixed housing 24, the front end (the first front end) 338 of the upper spring piece 328 and the front end (the second front end) 340 of the lower spring piece 330 of the second contact member 32 are received by the receiving portions 360 formed in the protruding portions 356 and 358 of the movable housing 35, respectively. The receiving portion 360 receiving the front end 338 of the upper spring piece 328 allows the front end 338 to move within a predetermined range and regulates movement of the front end 338 that is beyond the predetermined range. That is, the receiving portion 360 receiving the front end 338 of the upper spring piece 328 functions as a sixth regulating portion which regulates the movement of the front end 338. Accordingly, the upper spring piece 328 is prevented from buckling. Moreover, the receiving portion 360 receiving the front end 340 of the lower spring piece 330 allows the front end 340 to move within a predetermined range and regulates the front end 340 so that the front end 340 does not move beyond the predetermined range. That is, the receiving portion 360 receiving the front end 340 of the lower spring piece 330 functions as a seventh regulating portion which regulates the movement of the front end 340. Accordingly, the lower spring piece 330 is prevented from buckling. The same is applied to the front end (the first front end) 334 of the upper spring piece 308 and the front end (the second front end) 336 of the lower spring piece 310 of the first contact member 30. Thus, in the present embodiment, the first front ends 334 and 338 of the upper-side spring part 342 are received by the sixth regulating portions 360 so that their movement is regulated, and the second front ends 336 and 340 of the lower-side spring part 344 are received by the seventh regulating portions 360 so that their movement is regulated.

Figure 3:
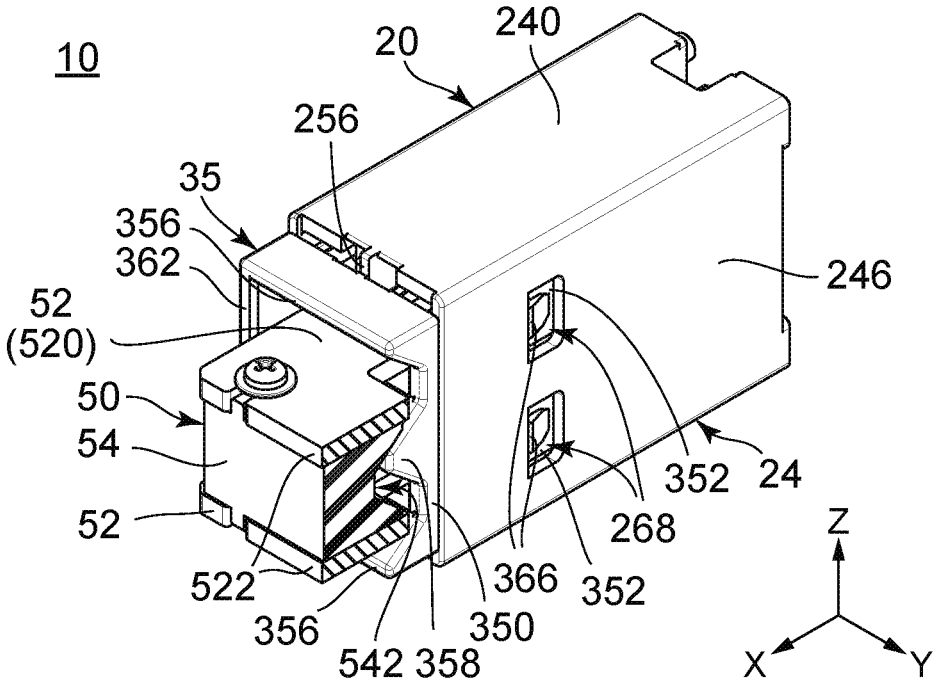
FIG. 3 is another front, perspective view showing the connector assembly of FIG. 1. The connector and the mating connector are mated with each other.
Figure 4:
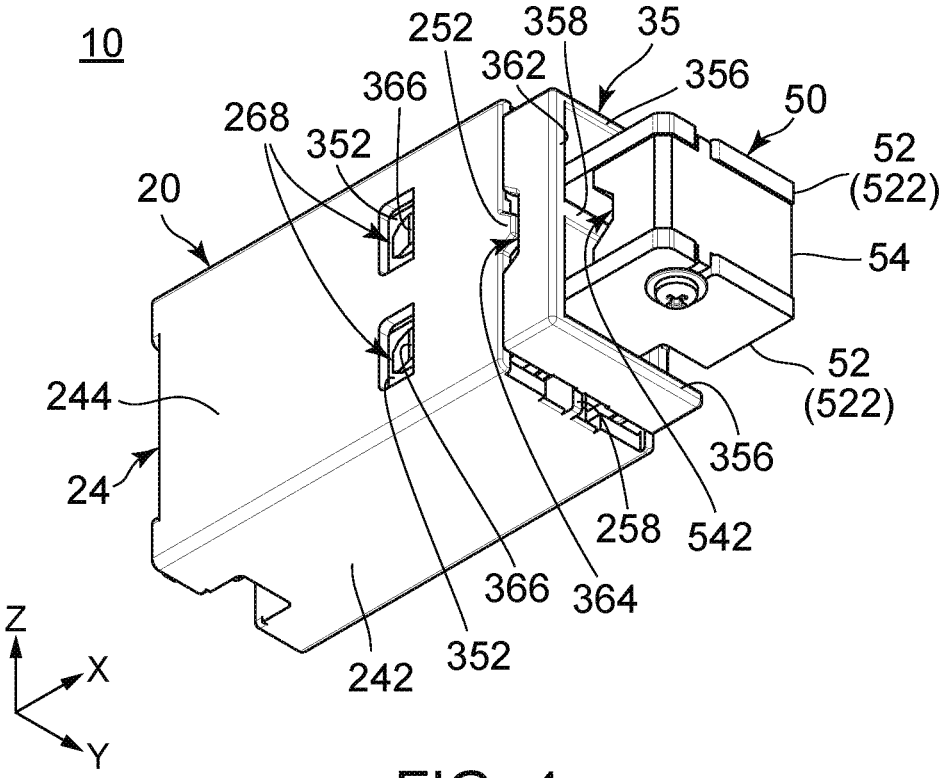
FIG. 4 is yet another front, perspective view showing the connector assembly of FIG. 3.

As understood from FIGS. 1 to 4, the wall 362 of the movable housing 35 is brought into abutment with the extension portions 522 of the busbars 52 to prevent the connection portions 520 from entering the upper accommodation portion 37U and the lower accommodation portion 37L when a connection of the mating connector 50 to the connector 20 in a wrong direction is attempted. When the mating connector 50 is connected to the connector 20 in a correct direction, the wall 362 does not prevent the connection portions 520 from entering into the upper accommodation portion 37U and the lower accommodation portion 37L. That is, the connection portions 520 of the busbars 52 are accommodated in the upper accommodation portion 37U and the lower accommodation portion 37L, respectively, through the opening portions 354 corresponding to them. Moreover, as shown in FIGS. 3 and 4, the protruding portion 358 of the movable housing 35 is received by the recess portion 542 of the busbar holder 54 at least in part.

As understood from FIG. 24, when the mating connector 50 (see FIG. 1) and the connector 20 (see FIG. 1) are mated with each other, the connection portion 520 of the busbar 52 is sandwiched, in the inside of each of the upper accommodation portion 37U (see FIGS. 5 to 8) and the lower accommodation portion 37L (see FIGS. 5 to 8), between the upper-side contact points 300 and 320 (see FIGS. 20 and 21) and the lower-side contact points 302 and 322 (see FIGS. 20 and 21) of the movable contact 28 corresponding thereto to be electrically connected to the movable contact 28. As a result, the busbars 52 are electrically connected to the fixed contacts 22 via the movable contacts 28.

When the mating connector 50 (see FIG. 1) is mated with the connector 20 (see FIG. 1), the movable housing 35 and the movable contacts 28 (see FIG. 7) move so as to absorb misalignment and inclination of a mating axis of the connector 20 with respect to a mating axis of the mating connector 50. In particular, the upper-side contact points 300 and 320 (see FIGS. 20 and 21) and the lower-side contact points 302 and 322 (see FIGS. 20 and 21) of the movable contact 28 move individually so as to absorb a turn (inclination) of the mating connector 50 around the mating axis thereof with respect to the connector 20. If a turning amount of the mating connector 50 around the mating axis thereof is constant, a movement amount of each of the upper-side contact points 300 and 320 and the lower-side contact points 302 and 322 depends on the position thereof in the lateral direction. In the present embodiment, the upper-side contact points 300 and 320 and the lower-side contact points 302 and 322 are positioned at the positions closer to the middle in the lateral direction (see FIGS. 22 and 23). Accordingly, the movement amount of each of the upper-side contact points 300 and 320 and the lower-side contact points 302 and 322 can be relatively small. In other words, the present embodiment can reduce the spatial margins allowing the upper-side contact points 300 and 320 and the lower-side contact points 302 and 322 to move. Thus, the connector 20 can be downsized. Additionally, as understood from FIGS. 22 and 23, the middle of the movable contact 28 in the first position P1 and the middle of the movable contact 28 in the second position P2 coincide with each other in the lateral direction in the present embodiment. However, the present invention is not limited thereto. Contact points may be provided so that the middle of the movable contact 28 in the second position P2 deviates from the middle in the first position P1.

Although the specific explanation about the present invention is made above referring to the embodiments, the present invention is not limited thereto but susceptible to various modifications and alterations. For example, in the aforementioned embodiment, the movable contact 28 may be composed of a single contact member to have at least one of a single upper-side gripping section and a single lower-side gripping section.

REFERENCE SIGNS LIST

10 Connector Assembly
20 Connector
22 Fixed Contact
220 Front Edge Portion
222 Rear Edge Portion
224, 226 Side Portion
228 Fixed Hole
230 First Step Portion
232 Second Step Portion
24 Fixed Housing
240 Upper Wall
242 Lower Wall
244, 246 Sidewall (Fourth Regulating Portion)
248 Rear Wall
250 Inner Space
250U Upper-Side Inner Space
250L Lower-Side Inner Space
252 Protrusion
254 Partition Wall
256, 258, 260 Partition Board (Fifth Regulating Portion)
262 Fixed Contact Supporting Portion
264 Groove
266 Round Portion (First Regulating Portion)
268 Aperture (Second Regulating Portion)
270 First Butted Portion
272 Second Butted Portion
28 Movable Contact
30 First Contact Member
32 Second Contact Member
300, 320 Upper-Side Contact Point
302, 322 Lower-Side Contact Point
304, 324 Upper-Side Gripping Section
306, 326 Lower-Side Gripping Section
308, 328 Upper Spring Piece
310, 330 Lower Spring Piece
312, 332 Joining Section
334, 338 Front End (First Front End)
336, 340 Front End (Second Front End)
342 Upper-Side Spring Part
344 Lower-Side Spring Part
35 Movable Housing
350 Frame Portion
352 Arm Portion
354 Opening Portion
356, 358 Protruding Portion
360 Receiving Portion (Sixth Regulating Portion, Seventh Regulating Portion)
362 Wall
364 Notch
366 Protrusion (Regulated Portion)
368 End Surface (Third Regulating Portion)
37U Upper Accommodation Portion
37L Lower Accommodation Portion
38 Spring Pin
50 Mating Connector
52 Busbar
520 Connection Portion
522 Extension Portion
54 Busbar Holder
542 Recess Portion

The invention claimed is:

1. A connector comprising a fixed contact, a fixed housing, a movable contact and a movable housing, wherein:

the movable housing has an opening portion;

the movable housing is attached to the fixed housing so as to be movable in an up-down direction;

the fixed housing and the movable housing define an accommodation portion;

the opening portion communicates with the accommodation portion and opens forward in a front-rear direction perpendicular to the up-down direction;

the fixed contact has a gripped portion;

the fixed contact is fixed to and held by the fixed housing;

the gripped portion is positioned in the accommodation portion and extends forward in the front-rear direction;

the movable contact comprises a first contact member and a second contact member;

each of the first contact member and the second contact member has an upper-side contact point, a lower-side contact point, an upper-side gripping section, a lower-side gripping section, an upper-side spring piece, a lower-side spring piece and a joining section;

the upper-side spring piece is resiliently deformable and supports the upper-side contact point and the upper-side gripping section;

the lower-side spring piece is resiliently deformable and supports the lower-side contact point and the lower-side gripping section;

the upper-side contact point and the lower-side contact point face each other in the up-down direction;

the upper-side contact point is movable due to resilient deformation of the upper-side spring piece;

the lower-side contact point is movable due to resilient deformation of the lower-side spring piece;

the upper-side gripping section and the lower-side gripping section grip the gripped portion of the fixed contact in the up-down direction;

the joining section joins the upper-side spring piece and the lower-side spring piece to each other;

a size of the joining section in the front-rear direction is smaller than a size of each of the upper-side spring piece and the lower-side spring piece in the front-rear direction;

in the front-rear direction, the joining section is positioned at a first position;

in the front-rear direction, the upper-side contact point and the lower-side contact point are positioned at a second position positioned frontward of the first position;

in the front-rear direction, the upper-side gripping section and the lower-side gripping section are positioned at a third position positioned rearward of the first position;

in a lateral direction perpendicular to both of the up-down direction and the front-rear direction, the upper-side spring piece has an upper-side first width in the first position and an upper-side second width in the second position;

a size of the upper-side second width is smaller than a size of the upper-side first width;

the first contact member and the second contact member are arranged in the lateral direction;

in the lateral direction, the upper-side contact point of the first contact member and the upper-side contact point of the second contact member are positioned between the joining section of the first contact member and the joining section of the second contact member;

in the lateral direction, the lower-side spring piece of the first contact member and the lower-side spring piece of the second contact member have a lower-side first width in the first position and a lower-side second width in the second position;

a size of the lower-side second width is smaller than a size of the lower-side first width;

in the lateral direction, the lower-side contact point of the first contact member and the lower-side contact point of the second contact member are positioned between the joining sections;

the upper-side spring piece of the first contact member and the upper-side spring piece of the second contact member have an upper-side third width in the third position;

the size of the upper-side second width is smaller than a size of the upper-side third width;

the lower-side spring piece of the first contact member and the lower-side spring piece of the second contact member have a lower-side third width in the third position; and the size of the lower-side second width is smaller than a size of the lower-side third width.

2. The connector as recited in claim 1, wherein, in the front-rear direction, a distance dimension between the first position and the second position is larger than a distance dimension between the first position and the third position.

3. The connector as recited in claim 1, wherein:

a size of the joining section in the up-down direction is smaller than a size of the upper spring piece in the front-rear direction; and the size of the joining section in the front-rear direction is larger than a size of the upper spring piece in the lateral direction.

4. The connector as recited in claim 1, wherein:

the fixed housing is provided with two first regulating portions and two second regulating portions;

the movable housing is provided with two arm portions, two third regulating portions and two regulated portions;

each of the arm portions supports one of the third regulation portions and one of the regulated portions;

the joining section of the first contact member and the joining section of the second contact member are positioned between the first regulating portions and the third regulating portions, and movement of the joining section of the first contact member and the joining section of the second contact member in the front-rear direction is regulated by the first regulating portions and the third regulating portions; and the second regulating portions allow the regulated portions to move within a predetermined range in the up-down direction and regulate movement of the regulated portions that is beyond the predetermined range.

5. The connector as recited in claim 4, wherein:

the fixed housing has two sidewalls;

the second regulating portions are apertures pierced through the sidewalls in the lateral direction;

the regulated portions are protrusions protruding outward in the lateral direction; and the regulated portions are positioned in the second regulating portions.

6. The connector as recited in claim 1, wherein:

the fixed housing has a fourth regulating portion and a fifth regulating portion; and in the first position, each of the first contact member and the second contact member is positioned between the fourth regulating portion and the fifth regulating portion.

7. The connector as recited in claim 1, wherein:

the movable housing has a sixth regulating portion and a seventh regulating portion;

the upper-side spring piece has a first front end;

the lower-side spring piece has a second front end;

the sixth regulating portion receives the first front end and regulates movement of the first front end; and the seventh regulating portion receives the second front end and regulates movement of the second front end.

8. A connector assembly comprising the connector as recited claim 1 and a mating connector, wherein:

the connector has two of the opening portions, two of the accommodation portions, two of the fixed contacts and two of the movable contacts;

the opening portions are juxtaposed with each other in the up-down direction;

the movable housing has a protruding portion which is positioned between the opening portions and which protrudes forward in the front-rear direction;

the mating connector is provided with two busbars and a busbar holder;

the busbars are integrally held by the busbar holder;

the busbar holder has a recess portion positioned between the busbars; and when the mating connector is connected to the connector, the protruding portion is received by the recess portion at least in part.

9. The connector assembly as recited in claim 8, wherein:

each of the busbars has a connection portion to be accommodated in the accommodation portion and an extension portion extending from the connection portion in a direction intersecting with the connection portion;

the movable housing has a wall protruding forward in the front-rear direction from one of edges of the opening portion, the edges forming a pair in the lateral direction; and when a connection of the mating connector to the connector in a wrong direction is attempted, the wall is brought into abutment with the extension portion and prevents the connection portion from entering the accommodation portion.

* * * * *